US009711916B2

(12) United States Patent
Savicki, Jr.

(10) Patent No.: US 9,711,916 B2
(45) Date of Patent: Jul. 18, 2017

(54) ELECTRICAL WIRING DEVICE WITH SHUTTERS

(71) Applicant: Pass & Seymour, Inc., Syracuse, NY (US)

(72) Inventor: Gerald R. Savicki, Jr., Canastota, NY (US)

(73) Assignee: PASS & SEYMOUR, INC., Syracuse, NY (US)

( * ) Notice: Subject to any disclaimer, the term of this patent is extended or adjusted under 35 U.S.C. 154(b) by 0 days.

(21) Appl. No.: 14/718,690

(22) Filed: May 21, 2015

(65) Prior Publication Data

US 2016/0104961 A1 Apr. 14, 2016

Related U.S. Application Data

(60) Provisional application No. 62/063,757, filed on Oct. 14, 2014, provisional application No. 62/079,028, filed on Nov. 13, 2014.

(51) Int. Cl.

| | |
|---|---|
| ***H01R 24/28*** | (2011.01) |
| ***H01R 25/00*** | (2006.01) |
| ***H01R 13/713*** | (2006.01) |
| ***H01R 13/453*** | (2006.01) |
| *H01R 107/00* | (2006.01) |
| *H01R 103/00* | (2006.01) |
| *H01R 24/76* | (2011.01) |

(52) U.S. Cl.

CPC ..... *H01R 24/28* (2013.01); *H01R 13/4534* (2013.01); *H01R 13/7135* (2013.01); *H01R 25/006* (2013.01); *H01R 24/76* (2013.01); *H01R 2103/00* (2013.01); *H01R 2107/00* (2013.01)

(58) Field of Classification Search

USPC ..... 439/138, 137, 107, 145; 174/53, 66

See application file for complete search history.

(56) References Cited

U.S. PATENT DOCUMENTS

| | | | | |
|---|---|---|---|---|
| 3,990,758 A * | 11/1976 | Petterson | ..... | H01R 13/4536 439/138 |
| 5,277,602 A * | 1/1994 | Yi | ..... | H01R 13/7036 439/138 |
| 5,702,259 A * | 12/1997 | Lee | ..... | H01R 13/4534 439/137 |
| 6,776,630 B1 * | 8/2004 | Huang | ..... | H01R 13/4534 439/137 |

(Continued)

*Primary Examiner* — Alexander Gilman

(74) *Attorney, Agent, or Firm* — Bond Schoeneck & King, PLLC; Frederick Price; George McGuire

(57) ABSTRACT

The present invention is directed to an assembly that includes a shutter having an interface portion coupled to a railed guidance structure so that the shutter rides the railed guidance structure from a return position to an open position in response to being engaged by the plurality of plug blades; the interface portion and the railed guidance structure allowing the shutter to rotationally align with the ends of the plug blades in response to an asymmetry in respective lengths of the plug blades. The open position permits electrical engagement of the plurality of plug blades with the plurality of receptacle contacts. The shutter is also directed from the return position to a blocking position in response to being engaged by a foreign object via one of the plurality of receptacle openings to prevent the foreign object from engaging the set of receptacle contacts.

40 Claims, 28 Drawing Sheets

(56) References Cited

U.S. PATENT DOCUMENTS

| | | | | |
|---|---|---|---|---|
| 6,893,275 | B2 * | 5/2005 | Ng | H01R 13/4534 439/137 |
| 7,355,117 | B2 * | 4/2008 | Castaldo | H01R 13/4534 174/53 |
| 7,527,508 | B1 * | 5/2009 | Lee | H01R 13/4534 439/137 |
| 7,637,756 | B1 * | 12/2009 | Hsu | H01R 13/4534 439/137 |
| 7,645,149 | B2 * | 1/2010 | Carbone | H01R 13/4534 439/137 |
| 7,651,347 | B2 * | 1/2010 | Germain | H01R 13/4534 439/137 |
| 7,820,909 | B2 * | 10/2010 | Castaldo | H01R 13/4534 174/53 |
| 8,044,299 | B2 * | 10/2011 | Weeks | H01R 13/4534 174/53 |
| 8,491,319 | B1 * | 7/2013 | Baldwin | H01R 13/4534 439/137 |
| 8,550,829 | B2 * | 10/2013 | Huang | H01R 13/4534 439/127 |
| 8,562,362 | B2 * | 10/2013 | Jiang | H01R 13/4534 439/137 |
| 9,048,559 | B2 * | 6/2015 | Huang | H01R 13/4534 |
| 9,059,529 | B1 * | 6/2015 | Lai | H01R 13/44 |
| 2008/0248662 | A1 * | 10/2008 | Bazayev | H01H 9/0264 439/107 |
| 2009/0236115 | A1 * | 9/2009 | Li | H01R 13/4534 174/53 |
| 2010/0041259 | A1 * | 2/2010 | Ni | H01R 13/4534 439/137 |

* cited by examiner

ELECTRICAL WIRING DEVICE WITH SHUTTERS

BACKGROUND OF THE INVENTION

1. Field of the Invention

The present invention relates generally to electrical wiring devices, and particularly to tamper-resistant electrical wiring devices.

2. Technical Background

Electrical power is provided to users by way of electrical distribution systems that typically include electrical wiring from a utility power source to a breaker panel disposed in a house, building or some other facility. The breaker panel distributes AC power to one or more branch electric circuits installed in the structure. The electric circuits may typically include one or more electrical wiring devices that regulate, monitor or provide AC power to other devices. Each electrical wiring device is equipped with electrical terminals that provide a means for connecting the device to the source of AC power and a means for connecting the device to a load. Specifically, line terminals couple the device to the source of AC electrical power, whereas load terminals couple power to the load. Load terminals may also be referred to as "feed-through" or "downstream" terminals because the wires connected to these terminals may be coupled to a daisy-chained configuration of receptacles or switches.

Thus, an electric circuit may include many different electrical wiring devices disposed at various locations throughout a structure. Outlet receptacles, switches and protective devices are examples or types of electrical wiring devices. Ground fault circuit interrupters (GFCIs), and are fault circuit interrupters (AFCIs) are examples of protective devices in electric circuits. Switches, protective devices and other types of electrical devices are often provided in combination with receptacles. For example, outlet receptacles are disposed in duplex receptacles, raceways, multiple outlet strips, power taps, extension cords, light fixtures, appliances, and the like. When the wiring terminations of these devices (i.e., wiring terminals, plugs, etc.) of these devices are connected to the electrical distribution system, the receptacle contacts may be energized. When the power cord of an electrical appliance is inserted into the receptacle outlet, the device is also energized.

When a foreign object is inserted into a receptacle opening it may represent a safety hazard. Specifically, young children and toddlers are known to have a proclivity toward inserting objects such as paper clips or screwdriver blades into receptacle contact openings. (This should be a cause for alarm, especially in light of the fact that, e.g., GFCIs are configured to trip in response to a mere 6 mA current). Even a small current (in the mA range) passing through a human body to ground can result in an electric shock, burns, or electrocution (a fatal shock event). As a result, the use of shuttered openings in electrical receptacles has long been in use in an attempt to prevent the insertion of foreign objects into the receptacle contact openings. One drawback to this approach relates to the ineffectiveness of related art designs. In many conventional designs, when objects are placed into both openings, the shutter will typically operate, exposing the child to a shock hazard. What is needed is a shutter mechanism that only opens when an actual corded plug is inserted into the receptacle.

Another drawback to this approach relates to the complexity of related art shutters. Many shutter designs comprise multiple parts and spring elements. For example, in one conventional approach that has been considered, the shutter must be intricately installed within a base platform (by hand) after positioning a delicate leaf spring element within the base. The cost and time of assembling the shutter mechanism, and the space taken up by their multiple parts, limit the usage of these designs. Moreover, automated environments often generate vibrations and mechanical forces that tend to introduce failure modes. Specifically, vibrations tend to cause the leaf spring to become dislodged or otherwise become separated from the platform. In addition, when objects are inserted into the receptacle opening, the shutter is forced to press against the leaf spring while moving upwardly and downwardly within the base platform. This type of movement increases the likelihood that the leaf spring will be dislodged. Once this happens, the receptacle device is either inoperable or unprotected.

What is needed is a shutter assembly that is configured to operate smoothly (and robustly) even when foreign objects or uneven plug blades are forcefully inserted. What is also needed is relatively simple protective shutter assembly that is easy to install within an electrical wiring device.

SUMMARY OF THE INVENTION

The present invention addresses the needs described above by providing a shutter assembly that is configured to operate smoothly (and robustly) even when foreign objects or uneven plug blades are forcefully inserted and robustly. The present invention also provides a relatively simple protective shutter assembly that is easy to install within an electrical wiring device.

One aspect of the present invention is directed to an electrical device that includes a housing having a front cover coupled to at least one body member. The front cover includes a plurality of receptacle openings in a major front surface thereof. The plurality of receptacle openings is configured to receive a plurality of plug blades of a corded electrical plug. The at least one body member includes at least one set of receptacle contacts having a hot receptacle contact and a neutral receptacle contact configured to mate with the plurality of plug blades when the corded electrical plug is inserted into the plurality of receptacle openings. A set of electrical terminations is accessible via at least one aperture in the housing, the at least one set of receptacle contacts being configured to receive electrical power from the at least a portion of the set of electrical terminations. A guidance structure corresponding to the at least one set of receptacles is coupled to the front cover, the guidance structure including a first guidance portion and a second guidance portion. A shutter assembly includes a shutter element coupled to the first guidance portion in a return position when not engaged by an object and rotatable about the first guidance portion from the return position to a shutter blocking position in response to being engaged by an object via one of the plurality of receptacle openings. The object is prevented from obtaining access to the at least one set of receptacle contacts in the blocking position. The shutter element is translated from the return position on the first guidance portion to an open position on the second guidance portion in response to being engaged by the plurality of plug blades via the plurality of receptacle openings. The shutter is coupled to the guidance structure so that the shutter rotationally self-aligns to the plurality of plug blades when the shutter element is translated from the return position to the open position wherein the plurality of plug blades are allowed to mate with the hot receptacle contact and the neutral electrical contact, respectively.

In one embodiment of the device, the shutter element is configured to rotationally self-align with end portions of the plurality of plug blades in response to an asymmetry in respective lengths of the plurality of plug blades.

In one embodiment of the device, the guidance structure includes a first rail and a second rail configured to couple the shutter element therebetween, each of the first rail and the second rail includes a first rail portion extending from an interior major surface of the front cover in a substantially perpendicular direction to a pivot position to form the first guidance portion, each of the first rail and the second rail further includes a second rail portion extending from the pivot position at a predetermined angle relative the first rail portion to form the second guidance portion.

In one version of the embodiment, the predetermined angle is greater than about thirty five degrees.

In one embodiment of the device, the shutter element includes a first major surface disposed on one side thereof and configured to be engaged by the plurality of plug blades, the shutter element further includes a second major surface disposed on a second side thereof, the first major surface being substantially parallel to the second major surface.

In one embodiment of the device, the shutter element includes a first major surface configured to be engaged by the plurality of plug blades, the shutter element further includes a first lateral rib portion disposed at a first edge of the first major surface and a second lateral rib portion disposed at a second edge of the first major surface parallel to the first edge, the first lateral rib portion and the second lateral rib portion being configured to prevent the first major surface from abutting an interior major surface of the front cover when the shutter assembly is disposed in the return position.

In one version of the embodiment, the shutter element is configured to move from the return position to the translational portion via the pivot position when the shutter element is engaged by the plurality of plug blades.

In one embodiment of the device, the guidance structure is configured as a yoke structure, the yoke structure includes a first railed bearing portion substantially disposed in parallel with a second railed bearing portion.

In one version of the embodiment, the shutter element includes a first lateral opening and a second lateral opening configured to be coupled to the yoke structure, the first lateral opening includes a first substantially radial bearing interface and the second lateral opening includes a second substantially radial bearing interface configured to ride the first railed bearing portion and the second railed bearing portion, respectively, from substantially the return position to the open position in response to being engaged by the plurality of plug blades.

In one embodiment of the device, the shutter element includes an aperture configured to allow one of the plurality of plug blades to pass through in the open position.

In one embodiment of the device, the shutter element includes a seat portion configured to accommodate a spring, the spring being disposed between the seat portion and an anti-probing portion of the front cover.

In one version of the embodiment, the spring is selected from a group of springs that include a torsion spring or a compression spring.

In one embodiment of the device, the guidance structure is an integrally molded feature of an interior surface of the front cover.

In one embodiment of the device, the housing includes a wiring device housing, a duplex receptacle housing, a decorator housing, an extension cord housing, a multiple outlet strip housing, a combination receptacle and switch housing.

In one embodiment, the device further includes a protection circuit, a ground fault circuit interrupter, an arc fault circuit interrupter, or a surge protective device.

In another aspect, the present invention is directed to an electrical device that includes a housing having a front cover coupled to at least one body member. The front cover includes a plurality of receptacle openings in a major front surface thereof, the plurality of receptacle openings being configured to receive a hot plug blade and a neutral plug blade of a corded electrical plug. The at least one body member includes at least one set of receptacle contacts having a hot receptacle contact and a neutral receptacle contact configured to mate with the hot plug blade and a neutral plug blade, respectively, when the corded electrical plug is inserted into the plurality of receptacle openings. A set of electrical terminations is accessible via at least one aperture in the housing, the at least one set of receptacle contacts being configured to receive electrical power from the at least a portion of the set of electrical terminations. A railed guidance structure corresponding to the at least one set of receptacle contacts is coupled to the front cover. A shutter assembly includes a shutter element having an interface portion coupled to the railed guidance structure so that the shutter element rides the railed guidance structure from a return position to an open position in response to being engaged by the plurality of plug blades. The interface portion and the railed guidance structure are configured to allow the shutter element to rotationally align with end portions of the plurality of plug blades in response to an asymmetry in respective lengths of the plurality of plug blades. The open position permits electrical engagement of the plurality of plug blades with the plurality of receptacle contacts. The shutter element is directed from the return position to a blocking position in response to being engaged by an object via at least one of the plurality of receptacle openings to prevent the object from obtaining access to the at least one set of receptacle contacts.

In one embodiment of the device, the shutter element includes a first major surface disposed on one side thereof and configured to be engaged by the plurality of plug blades, the shutter element further includes a second major surface disposed on a second side thereof, the first major surface being substantially parallel to the second major surface.

In one embodiment of the device, the shutter element includes a first major surface configured to be engaged by the plurality of plug blades, the shutter element further includes a first lateral rib portion disposed at a first edge of the first major surface and a second lateral rib portion disposed at a second edge of the first major surface parallel to the first edge, the first lateral rib portion and the second lateral rib portion being configured to prevent the first major surface from abutting an interior major surface of the front cover when the shutter assembly is disposed in the return position.

In one embodiment of the device, the shutter element is configured to rotate about a first rail portion of the railed guidance structure when moving from the return position into the blocking position in response to being engaged by the object.

In one version of the embodiment, the shutter element is configured to be translated from the first rail portion to a second rail portion of the railed guidance structure when moving from the return position to the open position when the shutter element is engaged by the plurality of plug blades.

In one version of the embodiment, the railed guidance structure includes a yoke structure coupled to the front cover, the yoke structure including a first railed bearing portion substantially disposed in parallel with a second railed bearing portion.

In one version of the embodiment, the shutter element includes a first indented opening and a second indented opening coupled to the yoke structure. The first indented opening includes a first substantially radial bearing interface and the second indented opening includes a second substantially radial bearing interface configured to ride the first railed bearing portion and the second railed bearing portion, respectively, from substantially the return position to the open position in response to being engaged by the plurality of plug blades, the shutter being coupled to the railed guidance structure so that the shutter rotationally self-aligns to the plurality of plug blades when the shutter element is translated from the return position to the open position wherein the plurality of plug blades are allowed to mate with the hot receptacle contact and the neutral electrical contact, respectively.

In one version of the embodiment, each of the first railed bearing portion and the second railed bearing portion include a first portion extending from an interior major surface of the front cover in a substantially perpendicular direction to a pivot position. Each of the first railed bearing portion and the second railed bearing portion further extend from the pivot position at a predetermined angle relative the first railed bearing portion such that the shutter element translates from the return position to the open position in a direction parallel to the interior major surface of the front cover a distance substantially equal to a width of one of the plurality of receptacle openings.

In one version of the embodiment, the predetermined angle is greater than about thirty five degrees.

In one embodiment of the device, the shutter element includes an aperture configured to allow one of the plurality of plug blades to pass through in the open position.

In one version of the embodiment, the shutter element includes a seat portion configured to accommodate a spring, the spring being disposed between the seat portion and an anti-probing portion of the front cover.

In one version of the embodiment, the spring is selected from a group of springs that include a torsion spring or a compression spring.

In one embodiment of the device, the return position is centered about an axis parallel to a major surface of the front cover and varies within a predetermined angular range.

In one version of the embodiment, the predetermined angular range ($\Delta R$) is about $-8° \leq \Delta R \leq +8°$.

In yet another aspect of the present invention, an electrical wiring device includes a housing having a front cover coupled to at least one body member, the front cover including a plurality of receptacle openings in a major front surface thereof. The plurality of receptacle openings is configured to receive a hot plug blade and a neutral plug blade of a corded electrical plug. The at least one body member includes at least one set of receptacle contacts including a hot receptacle contact and a neutral receptacle contact configured to mate with the hot plug blade and the neutral plug blade, respectively, when the corded electrical plug is inserted into the plurality of receptacle openings. A set of electrical terminations is accessible via at least one aperture in the housing, the at least one set of receptacle contacts being configured to receive electrical power from the at least a portion of the set of electrical terminations. A yoke structure is coupled to the front cover, the yoke structure includes a first railed bearing portion substantially disposed in parallel with a second railed bearing portion, the yoke structure defining a first portion and a translational portion. A shutter assembly includes a shutter element having a first indented opening and a second indented opening coupled to the first railed bearing portion and the second railed bearing portion respectively. The first indented opening includes a first substantially radial bearing interface and the second indented opening includes a second substantially radial bearing interface configured to ride the first railed bearing portion and the second railed bearing portion, respectively, from a return position to an open position in response to being engaged by the plurality of plug blades. The open position permits electrical engagement of the plurality of plug blades with the plurality of receptacle contacts. The yoke structure is configured to rotate the shutter element from the return position to a blocking position when disposed on the first portion in response to being engaged by an object via at least one of the plurality of receptacle openings to prevent the object from obtaining access to the at least one set of receptacle contacts.

In one embodiment of the device, the shutter element includes a first major surface disposed on one side thereof and configured to be engaged by the plurality of plug blades, the shutter element further includes a second major surface disposed on a second side thereof, the first major surface being substantially parallel to the second major surface.

In one embodiment of the device, the shutter element includes a first major surface configured to be engaged by the plurality of plug blades, the shutter element further includes a first lateral rib portion disposed at a first edge of the first major surface and a second lateral rib portion disposed at a second edge of the first major surface parallel to the first edge, the first lateral rib portion and the second lateral rib portion being configured to prevent the first major surface from abutting an interior major surface of the front cover when the shutter assembly is disposed in the return position.

In one embodiment of the device, the each of the first railed bearing portion and the second railed bearing portion include a first portion extending from an interior major surface of the front cover in a substantially perpendicular direction to a pivot position, each of the first railed bearing portion and the second railed bearing portion further extending from the pivot position along the translational portion at a predetermined angle relative the first portion, wherein the shutter element is translated from the return position to the open position in a direction parallel to the interior major surface of the front cover a distance substantially equal to a width of one of the plurality of receptacle openings.

In one version of the embodiment, the predetermined angle is greater than about thirty five degrees.

In one embodiment of the device, the shutter element includes an aperture configured to allow one of the plurality of plug blades to pass through in the open position.

In one embodiment of the device, the shutter element includes a seat portion configured to accommodate a spring, the spring being disposed between the seat portion and an anti-probing portion of the front cover.

In one version of the embodiment, the spring is selected from a group of springs that include a torsion spring or a compression spring.

In one embodiment of the device, the housing includes a wiring device housing, a duplex receptacle housing, a decorator housing, an extension cord housing, a multiple outlet strip housing, a combination receptacle and switch housing.

In one embodiment the device further includes a protection circuit, a ground fault circuit interrupter, an arc fault circuit interrupter, or a surge protective device.

In one embodiment of the device, the shutter element is configured to rotationally align with end portions of the plurality of plug blades in response to an asymmetry in respective lengths of the plurality of plug blades.

Reference is made to U.S. Pat. No. 8,044,299, which is incorporated herein by reference as though fully set forth in its entirety, for a more detailed explanation of an electrical device being configured to accommodate a shutter assembly in the front cover thereof. To be specific, U.S. Pat. No. 8,044,299 discloses a GFCI electrical device, an AFCI electrical device, 15 A electrical device, 20 A electrical device, a GFCI/switch combination electrical device, GFCI/Night light combination electrical device, a TVSS electrical device, a power outlet strip electrical device, a portable electrical device, and a raceway electrical device, all of which are configured to accommodate a shutter assembly in the front cover thereof and all of which are incorporated herein by reference as though fully set forth in their entirety.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

The accompanying drawings are included to provide a further understanding of the invention, and are incorporated in and constitute a part of this specification. The drawings illustrate various embodiments of the invention and together with the description serve to explain the principles and operation of the invention.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
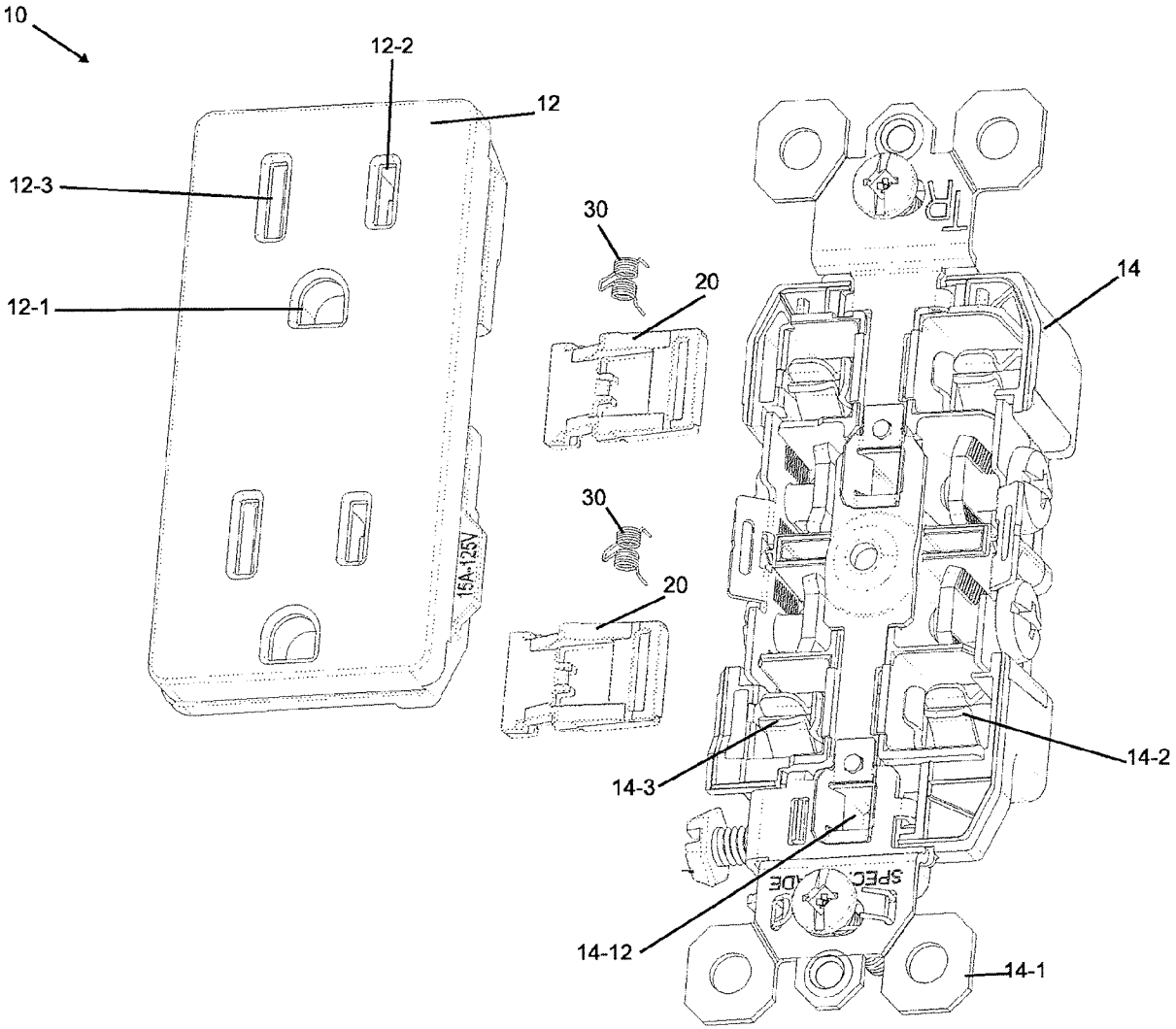
FIG. 1 is a perspective view of an electrical device with the front cover and the shutter assemblies removed in accordance with an embodiment of the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of an electrical device with a shutter assembly of the present invention is shown in FIG. 1. Specifically, the electrical wiring device is designated generally throughout by reference numeral 10 or 10', the shutter by reference numeral 20 or 20', and the spring by reference numeral 30 or 30'. As described in further detail below, the shutter 20 or 20' of the present invention features four shutter positions: three shutter positions (i.e., return, hot blocking and neutral blocking) correspond to the pivotal portion of the guide structure, and one shutter position (open) corresponds to a translational portion of the guide structure.

With reference to FIG. 1, the proposed 15A shutter design may be used in an electrical wiring device 10, which is shown herein as a 15 A receptacle device. Obviously, the proposed shutter design may be adapted for use in protective wiring devices such as GFCIs, AFCIs, TVSSs and the like. Upon information and belief, the proposed shutter design may be adapted for use in other electrical wiring devices.

Receptacle 10 includes a cover 12 and a back body 14. The receptacle 10 is a duplex device and thus provides two sets of plug blade openings, one set at each end thereof. Each set of plug blade openings includes a ground prong aperture 12-1, a hot opening 12-2 and a neutral opening 12-3. The cover 12 is configured to mate with a back body 14 that includes a ground strap 14-1, a hot conductor that includes hot contacts 14-2 and a neutral conductor that includes neutral contacts 14-3. The ground aperture 12-1 is thus in communication with a ground contact 14-12 formed in the ground strap 14-1, the hot aperture 12-2 is in communication with a hot contact 14-2 and the neutral aperture 12-3 is in contact with a neutral contact 14-3. The shutter 20 is positioned between each set of hot and neutral plug blade openings (12-2, 12-3 respectively) and their corresponding hot and neutral contacts (14-2, 14-3, respectively). Shutter 20 may also be employed in receptacle configurations in which a ground contact and aperture are omitted, referred to as a "two opening receptacle." Each shutter 20 is equipped with a dual-torsion return spring 30 that is configured to move the shutter to a "return" position when no external force is applied to the shutter (either by corded plug blades or by a foreign object).

Figure 2:
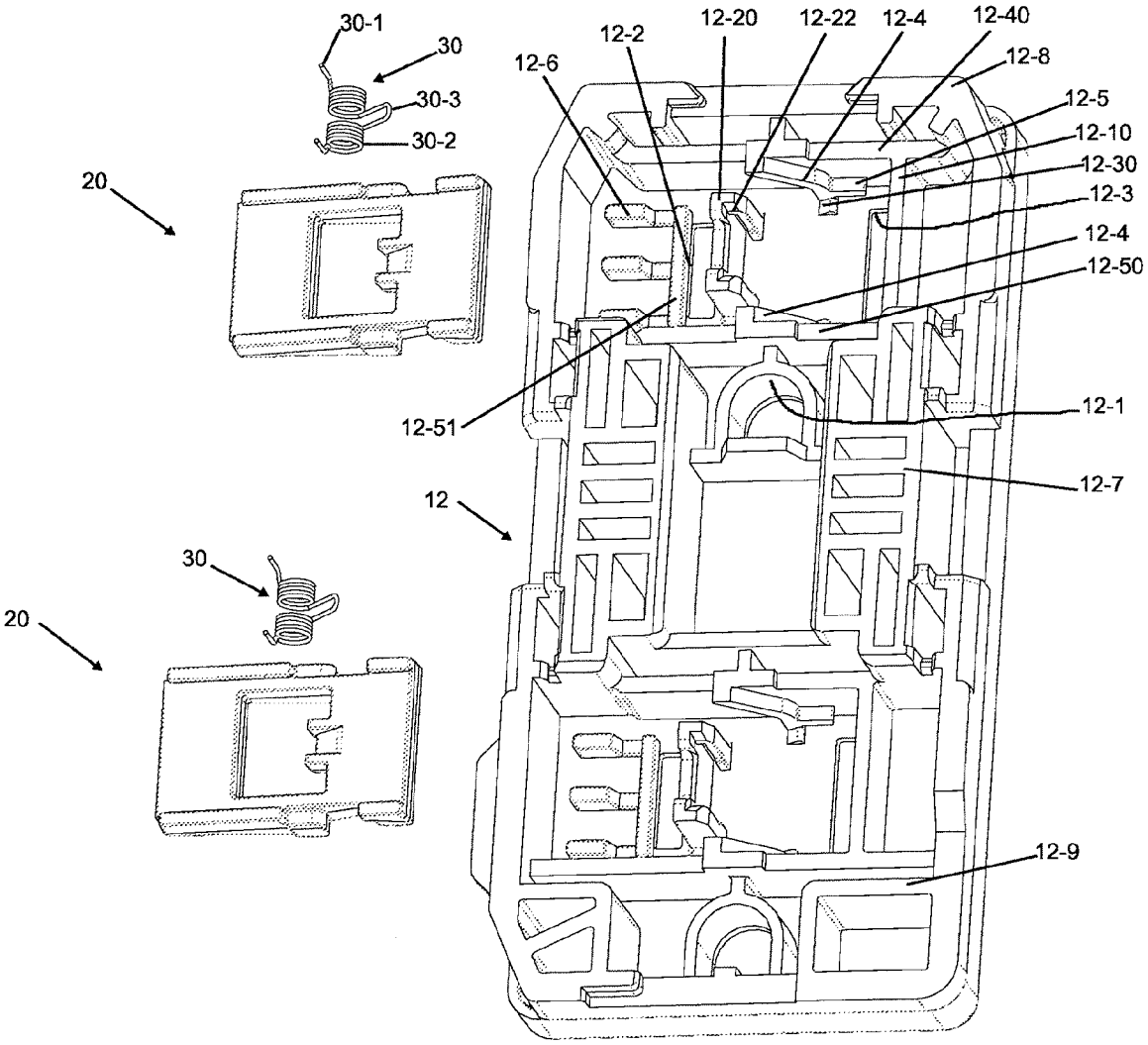
FIG. 2 is a perspective view of an interior of the front cover and the shutter assemblies depicted in FIG. 1.

In reference to FIG. 2, the two piece shutter assembly—including the shutters 20 and their corresponding return springs 30—are shown prior to being inserted into the rear portion of the cover 12. The shutter 20 is described in detail with reference to FIGS. 4A and 4B below. The dual torsion spring 30 includes retention portions 30-1 at each side thereof, the retention portions 30-1 are configured to be inserted into snap-in ("spring catch") elements 12-22 formed in the anti-probing wall 12-20 (adjacent to the hot aperture 12-2) of cover 12. The return spring 30 further comprises a central bearing portion 30-3 that is configured to engage the spring 30; the bearing portion 30-3 is disposed between each coiled spring element 30-2. Upon information and belief, each coiled spring element 30-2 is approximately 0.1 inches in diameter and is fabricated from a wire that is 0.01 inches in diameter. The return spring 30 is configured to apply approximately 100-200 grams of rotational force to the shutter 20 in order to set the shutter 20 in the return position.

The interior portion of the cover 12 includes a plurality of gussets (i.e., structural ribs) 12-7, 12-8, 12-9, 12-40 and 12-50 that are configured to provide the cover 12 with a certain amount of rigidity so that it resists bending and deformation due to twisting or torsional forces. Gusset 12-50 is also employed to electrically isolate the ground opening 12-1 from the hot and neutral conductors (14-2, 14-3, not shown). In addition, gussets 12-40 and 12-50 are spaced apart to accommodate a shutter 20 therebetween. To be clear, the shutter 20 is not retained or confined between ribs 12-40 and 12-50 by frictional fit. As described in greater detail below, there is functional clearance between the gussets 12-40 and 12-50 that allows the shutter 20 to move side-to-side. The interior face of each gusset 12-40, 12-50 is used to support a guide rib 12-4. Attached to each guide rib 12-4 and extending along substantially parallel to gusset 12-40, 12-50 is a shutter catch 12-5. Extending substantially perpendicular from the each guide rib 12-4 and shutter catch 12-5 is a return rib 12-30. The return rib 12-30 is formed on the interior major surface of front cover 12 as shown. The interior portion of the cover 12 also includes a plurality of stand-off elements 12-6, anti-probing walls 12-10, and 12-51.

The purpose and unique functionality of the guide rib 12-4, shutter catch 12-5, return rib 12-30, stand-off elements 12-6, and anti-probing walls 12-10, 12-20, and 12-51, are explained in further detail below with reference to FIGS. 6-9B. This unique functionality is based on the unique structure, positioning of these elements within the interior portion of the cover 12, and the relationship of these elements with the unique structural aspects of shutter 20.

Figure 3:
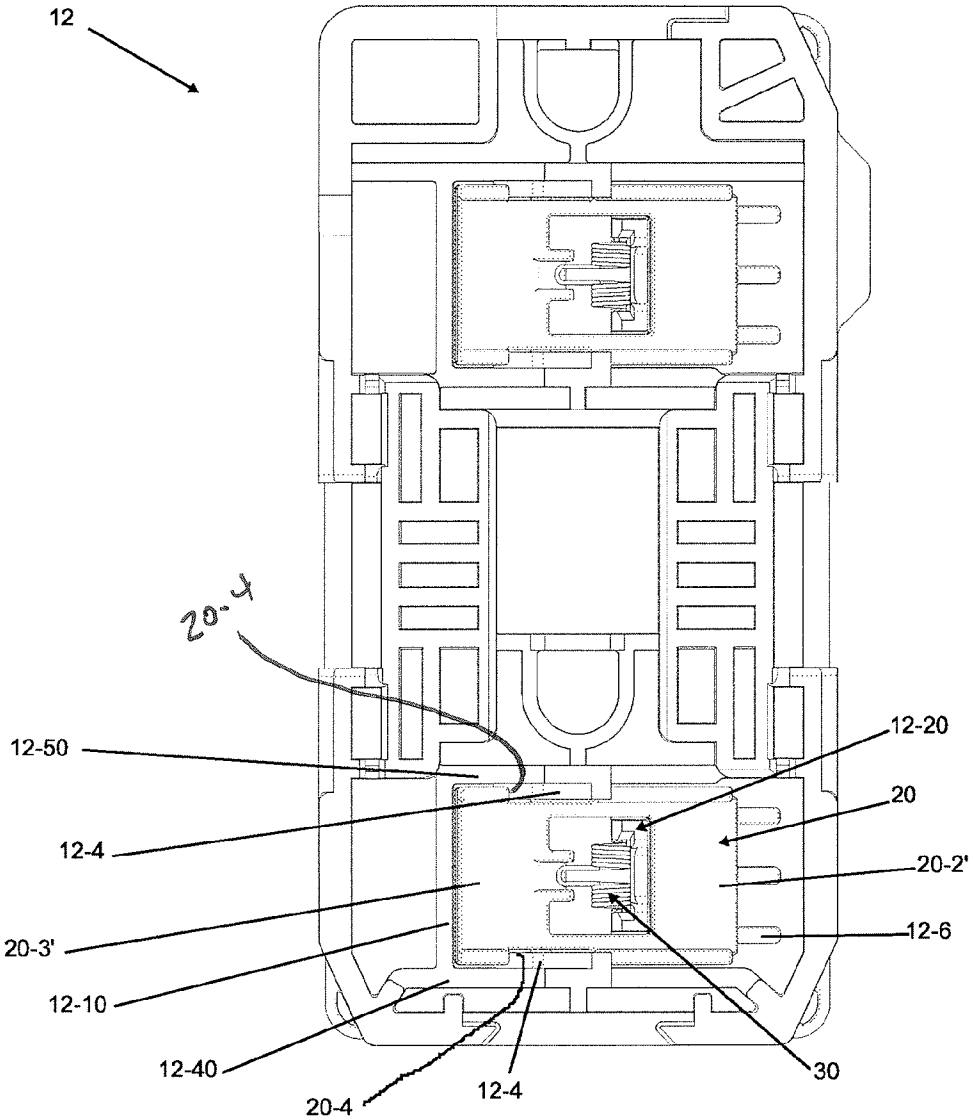
FIG. 3 is a perspective view of an interior of the front cover with the shutter assemblies installed in accordance with the present invention.

Referring to FIG. 3, the two piece shutter assembly (20, 30) is shown disposed in the interior portion of the cover 12. In this view, the guide ribs 12-4 are disposed within openings 20-4; each opening 20-4 is configured as an indented or recessed region formed in the side of the shutter. Moreover, the recessed openings 20-4 allow the shutter to move about the guide rails 12-4; i.e., no part of the shutter 20 mates with, or performs a snap-fit with the guide rails 12-4, including catch detents 20-8. The interior major surface 20-2' of the hot blocking pad is suspended partially over the stand-off elements 12-6. Similarly, the interior major surface 20-3' of the neutral blocking pad is suspended partially over the shutter catches 12-5 and over return ribs 12-30 (not visible in this view). The return spring 30 applies a small force to the shutter 20 such that it is disposed in the return position.

Figure 4B:
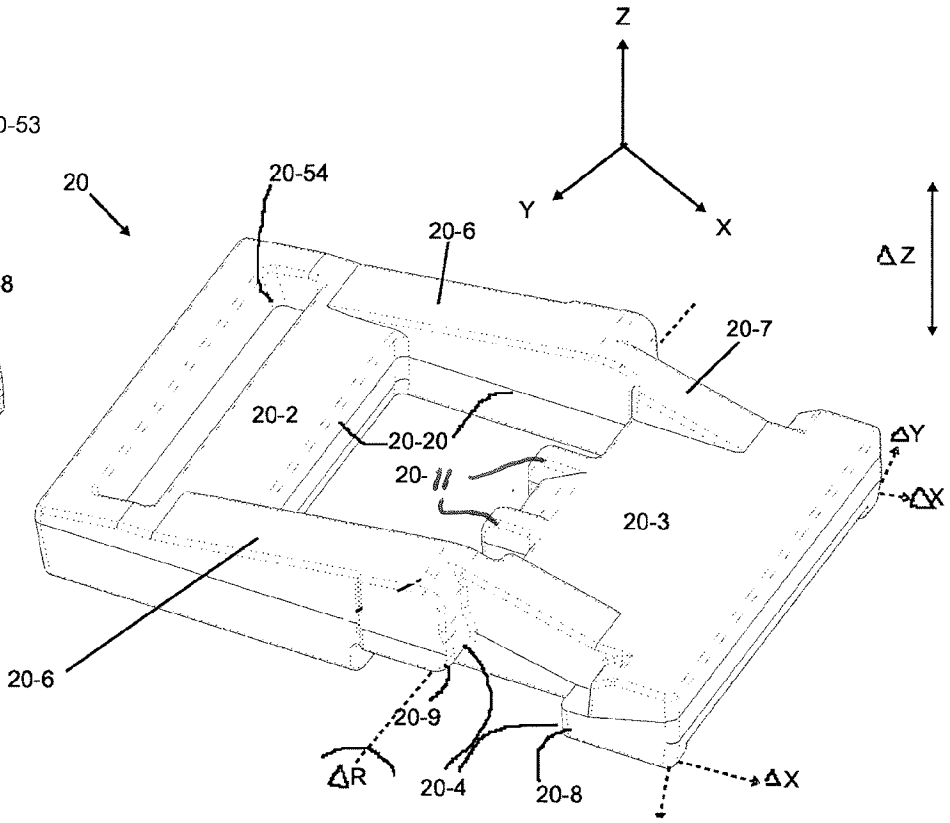
FIGS. 4A-4B are perspective views showing an underside and a topside, respectively, of the shutter element depicted in FIG. 1.
Figure 4A:
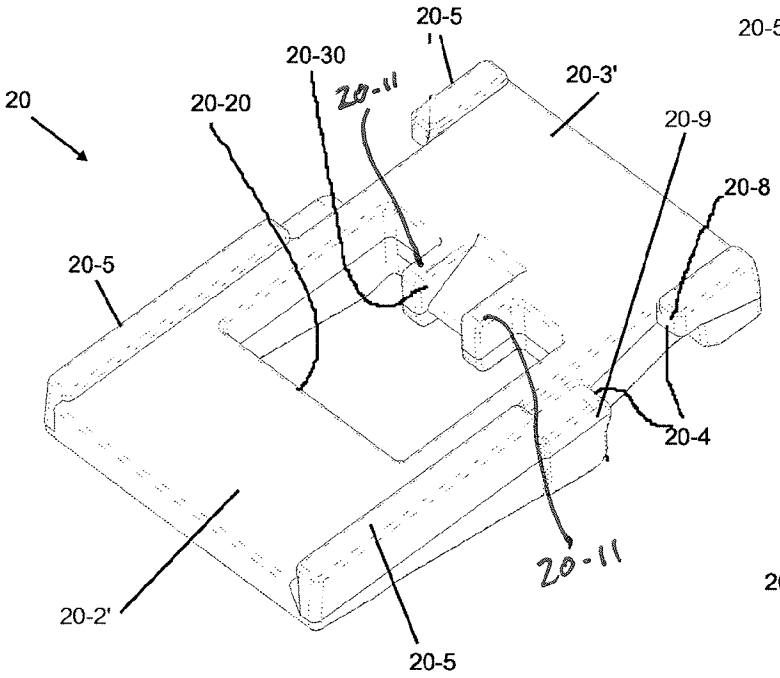

Referring now to FIGS. 4A and 4B, isometric detail views of the shutter 20 are provided. The shutter 20 is fabricated by, e.g., injection molding a suitable plastic material such as Nylon, Polycarbonate, Acetal, Acrylic, Polyester, polyurethane, etc.

FIG. 4A shows the underside of the shutter 20, i.e., the major surface that faces the interior of the device 10 when the shutter is installed within the cover 12. In this view, the interior major surface 20-2' of the hot blocking pad 20-2 is shown to the left of the opening 20-20 and the interior major surface 20-3' of the neutral blocking pad 20-3 is shown to the right thereof. (Pads 20-2 and 20-3 are shown in FIG. 4B). Because the shutter 20 is a relatively thin structure (approximately $1/16^{th}$ of an inch), gussets 20-5 are formed around a perimeter portion of the shutter 20 to provide strength and rigidity. The aperture 20-20 is disposed between the hot blocking pad 20-2 and the neutral blocking pad 20-3, and is configured to allow a hot plug blade to pass through when the shutter 20 is in an open position.

A lateral opening 20-4, i.e., a recessed region or indentation, is formed in each side of shutter 20 to accommodate the guide ribs 12-4 therewithin. Specifically, the opening 20-4 provides a sufficient amount of clearance so that the shutter 20 can move freely about the guide rails 12-4 as it translates from the return position to the open position. Thus, during this translational movement, the bearing surfaces 20-9 make glancing or tangential contact with the guide ribs 12-4 so that the shutter 20 moves in two dimensions x, z about the guide rib 12-4. (FIG. 4B shows the dimensional axes x, y, and z to represent the three dimensional operating space of the shutter 20). Moreover, a functional clearance is provided in the y-direction ($\Delta y$) between the lateral edges of the shutter 20 and the side walls 12-40 and 12-50. (There is no friction fit or interference fit between the shutter edges and the walls 12-40, 12-50). Thus, when the shutter is translated in the x-z plane by a corded plug, or rotated in the x-z plane by an object, it is free to wobble in all three dimensions ($\Delta x$, $\Delta y$, $\Delta z$). This "give" or ability to float or wobble around the ribs 12-4 substantially prevents the shutter from becoming damaged, jammed or stuck after repeated usage. The shutter's ability to "float" enables the shutter to accommodate plug blades that are not perfectly parallel, bent or are not of equal length, or plug blade edges that are sharp (and can gouge and nick the shutter). In brief, the floating ability also allows the user to insert the plug at an angle without jamming or damaging the shutter.

FIG. 4B shows the topside of the shutter 20, that is, the side that faces the cover 12 when the shutter is installed therein. The hot blocking pad 20-2 and the neutral blocking pad 20-3 are substantially flat planar surfaces, i.e., they are not inclined. The shutter 20 further includes interior gussets 20-11 that form a spring seat 20-30 for return spring 30. Specifically, the spring seat 20-30 is configured to accommodate the central bearing portion 30-3 of spring 30. However, the shutter 20 does not retain any portion of the spring 30. In other words, the shutter 20 and the spring 30 do not form a module; they are only coupled together within the front cover 12. Referring back to FIG. 2, the anti-probing wall 12-20 is disposed within the shutter aperture 20-20; when the shutter is installed in the cover 12. However, the shutter 20 and the anti-probing wall 12-20 are not connected to each other. Finally, the topside of the shutter 20 includes gussets 20-6 and 20-7; these elements have the same function as the perimeter gussets 20-5 shown in FIG. 4A (i.e., they provide strength and rigidity to the shutter 20).

Figure 5A:
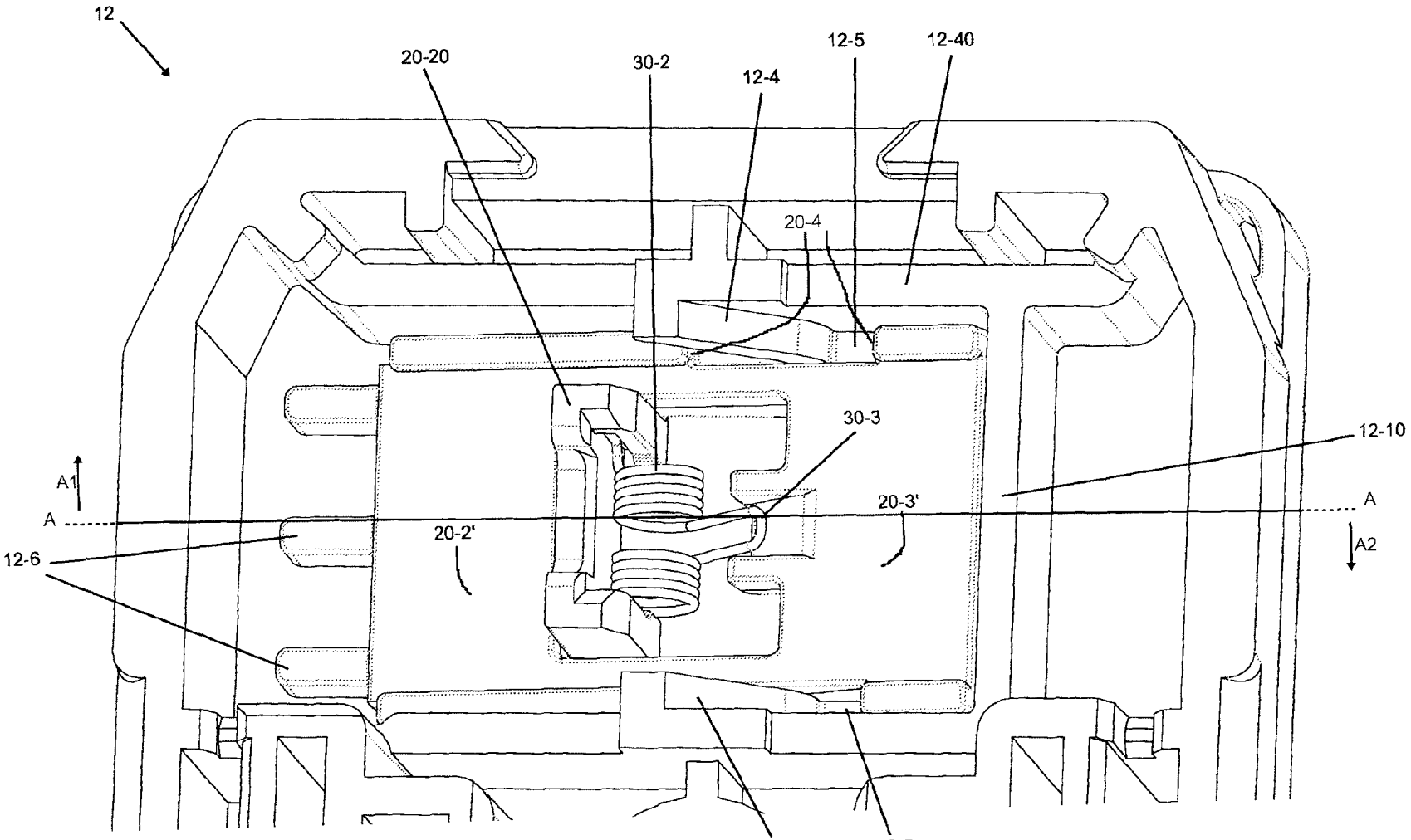
FIGS. 5A-5B are detail views showing an interior of the front cover with an installed shutter assembly in a return position and in an open position, respectively, in accordance with the present invention.
Figure 5B:
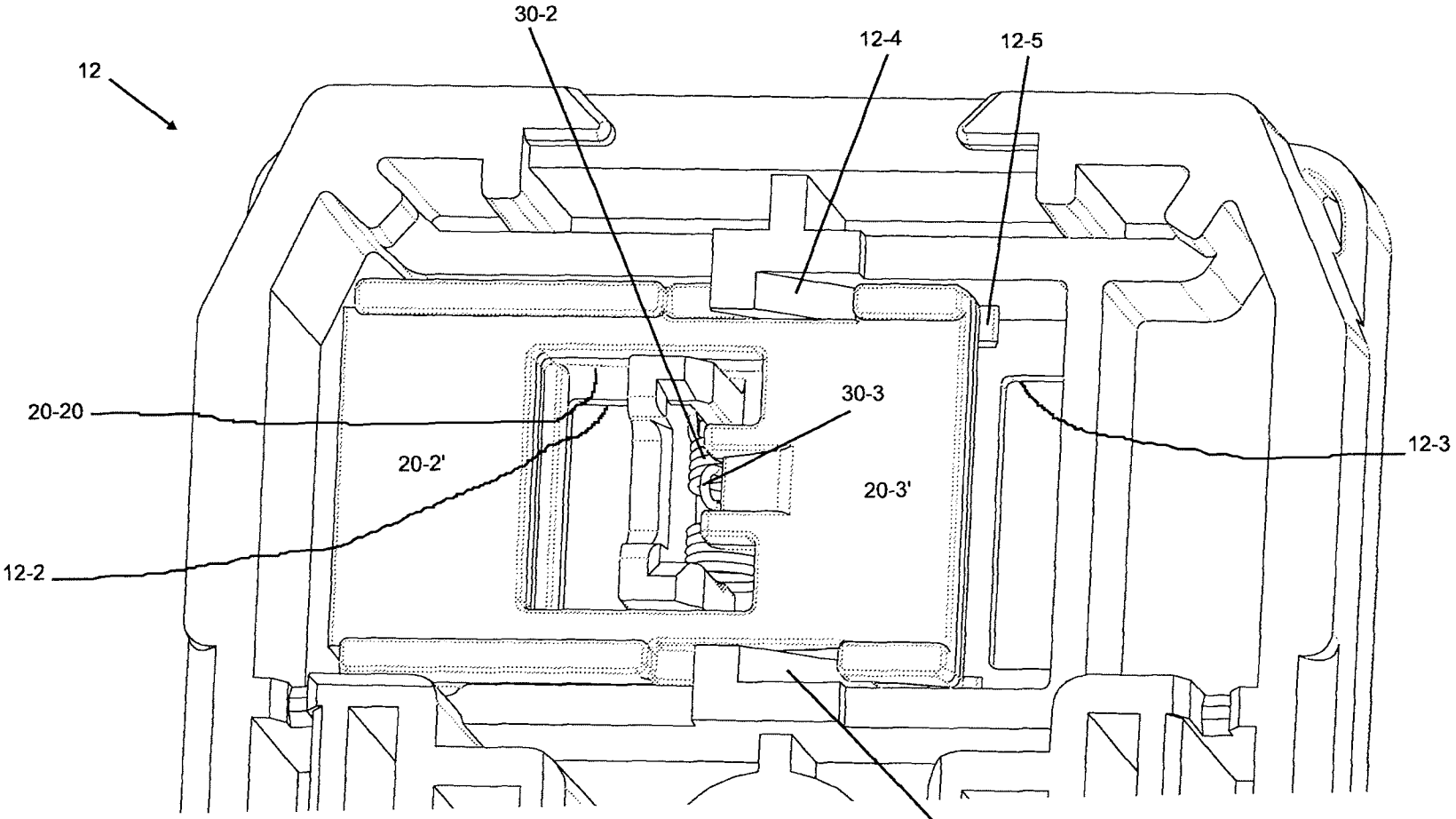

Referring to FIGS. 5A and 5B, in situ detail views of the underside of shutter 20 in the return position and in the open positions are shown. FIG. 5A includes a sectional line A-A; arrow A1 indicates a first sectional viewpoint whereas arrow A2 indicates the opposite sectional viewpoint. See FIGS. 7-9.

FIG. 5A shows the underside of the shutter 20 when it is in the return position and is a detail view of FIG. 3. In this view, the guide ribs 12-4 are disposed within the openings 20-4. The interior major surface 20-2' of the hot blocking pad is suspended partially over the stand-off elements 12-6. Similarly, the interior major surface 20-3' of the neutral blocking pad is suspended partially over the stand-off elements 12-5 and over the return ribs 12-30 (not visible in this view). The shutter spring 30 applies a small force to the shutter 20 toward the interior surface of the front cover 12 such that the shutter 20 is in the return position.

In FIG. 5B, the underside of the shutter 20 is shown in the open position. The force applied by the corded plug blades moves the shutter 20 to the left (in this view) so that the cover aperture 12-2 and the cover aperture 12-3 are misaligned with the shutter contact pads 20-2, 20-3, respectively, to allow the corded plug blades to mate with contacts 14-2 and 14-3 (not shown).

With reference to FIGS. 6-9B, the shutter 20 may be in one of four shutter positions that correspond to one of two guide rail 12-4 portions. Specifically, the guide rail 12-4 includes a pivotal region 12-4-1 and a translational region 12-4-2. When the shutter 20 is disposed in the pivotal region 12-4-1, the shutter may be in the return position, a hot blocking position or a neutral blocking position. When the shutter 20 is disposed in the translational portion of the guide structure, the shutter is in or moving to the open position.

Figure 6:
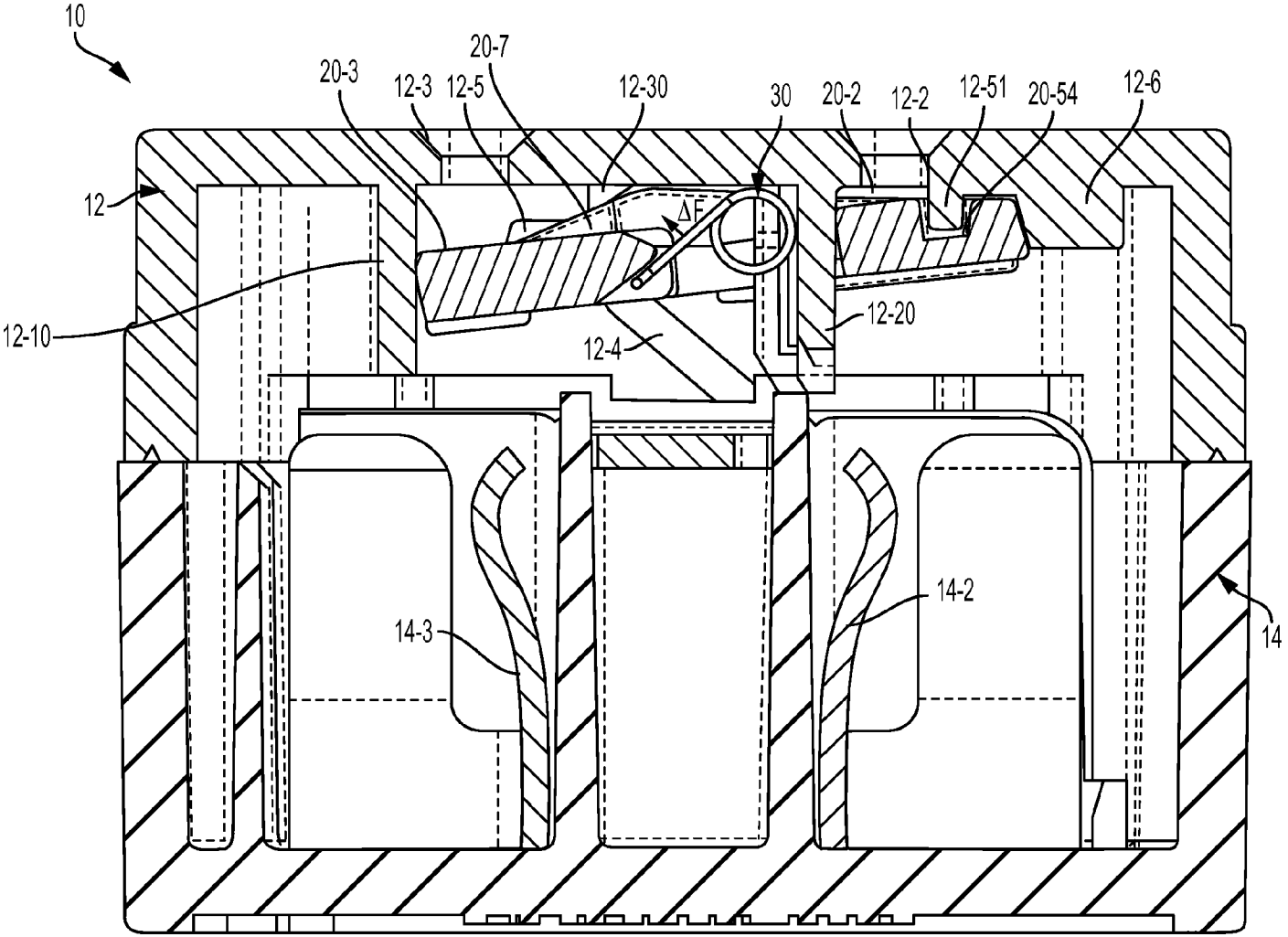
FIG. 6 is a cross sectional view of the shutter assembly in a return position in accordance with the present invention.

Referring to FIG. 6, a cross-sectional view of an electrical wiring device 10 taken along section-A1 (FIG. 5A) is shown, with the shutter 20 in the return position. During assembly, the spring 30 is installed to position the shutter 20 in the return position per a translational force "F" as shown. The return spring 30 applies approximately 100-200 grams of translational force to bias the shutter 20 against return ribs 12-30. In this position, the anti-probing slot 20-54 is engaged with the anti-probing wall 12-51 and the far edge 20-53 of shutter contact pad 20-2 is engaged with stand-off element 12-6.

Figure 7A:
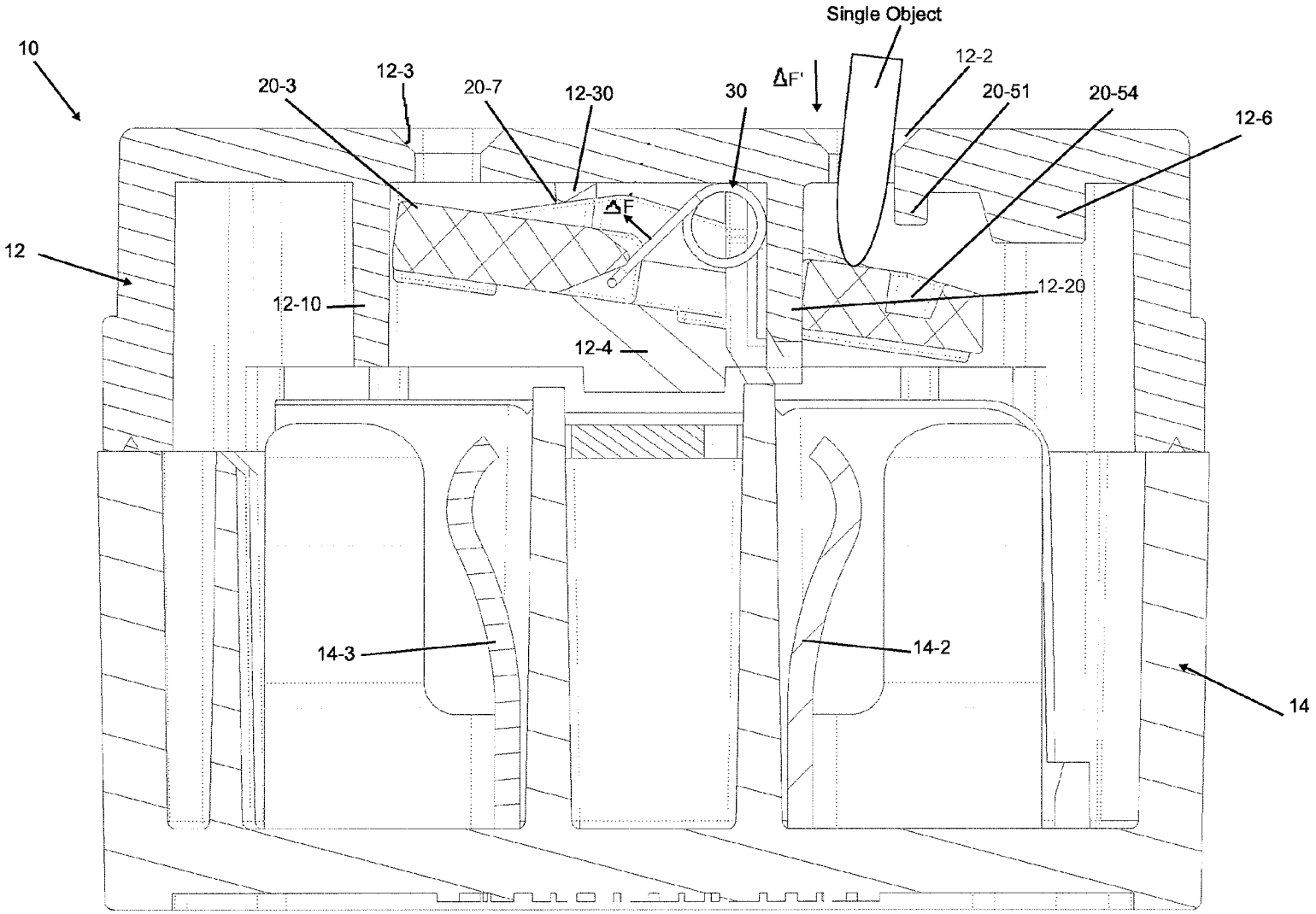
FIG. 7A-7D are cross sectional views of the shutter assembly in a hot blocking position or a neutral blocking position in accordance with the present invention.
Figure 7B:
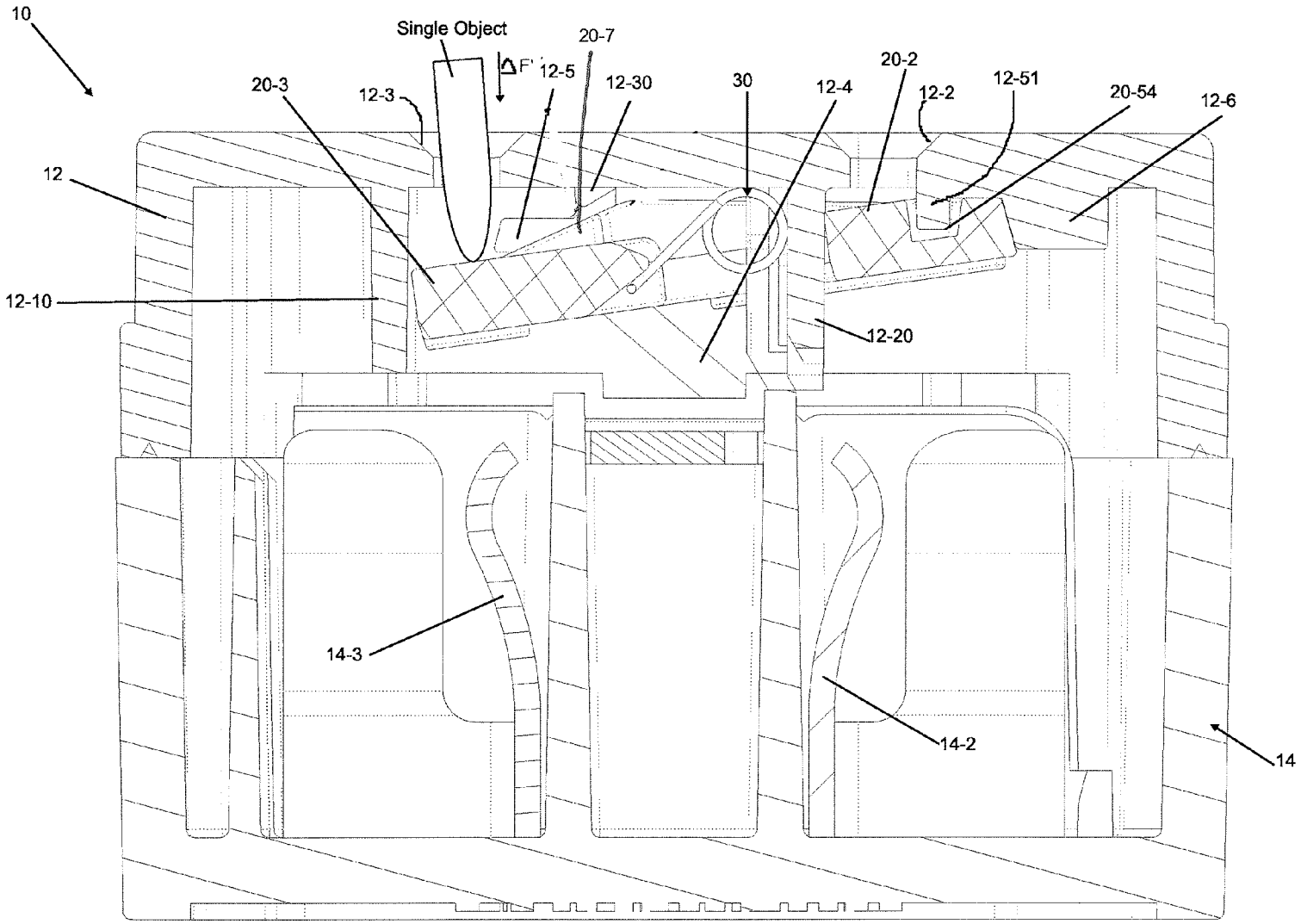
Figure 7C:
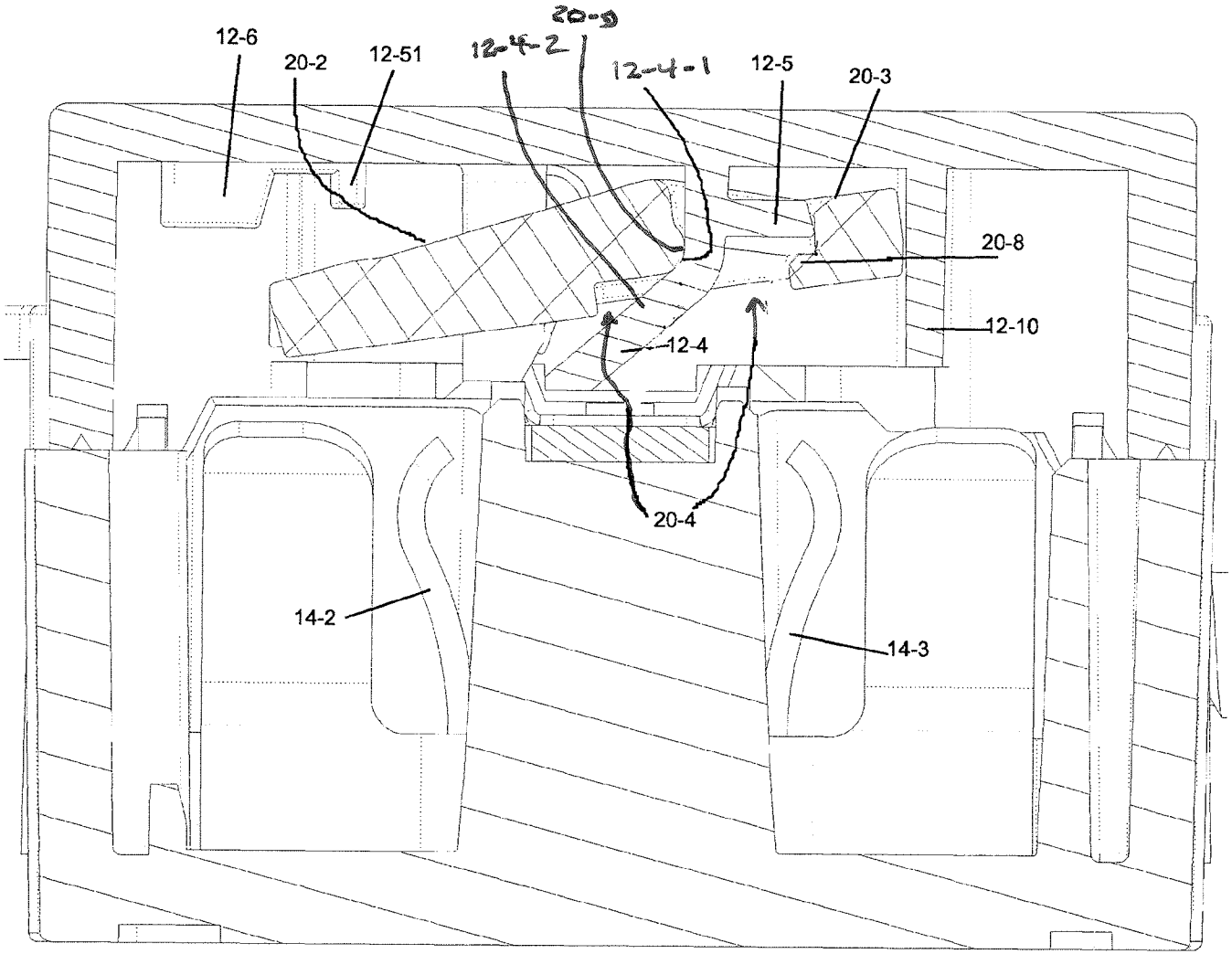
Figure 7D:
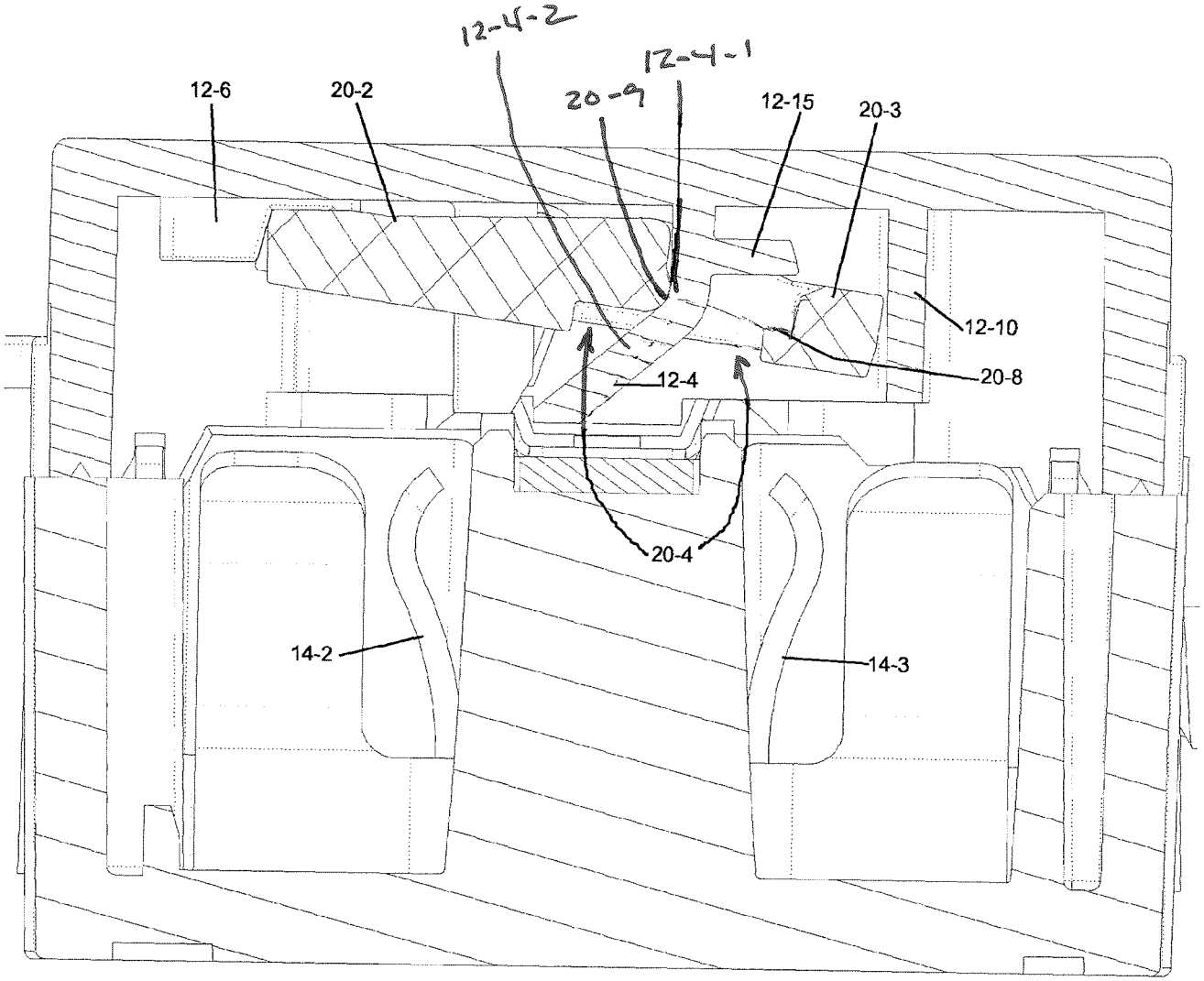

Referring to FIGS. 7A, 7B, 7C and 7D, cross-sectional views of the electrical wiring device 10 are shown when a single foreign object is inserted into one of the cover apertures (12-2, 12-3). FIGS. 7A and 7B are cross-sectional views of an electrical wiring device 10 taken along "A1" of the view illustrated in 5A. FIGS. 7C and 7D are cross-sectional views of an electrical wiring device 10 taken along "A2" of the view illustrated in 5A. In these views, the shutter 20 is rotated from the return position into one of the blocking positions to defeat an object inserted into a single opening.

For example, FIG. 7A shows an object being inserted into the hot aperture 12-2, whereas FIG. 7C shows the opposite cross sectional view. FIG. 7C provides a better view of the pivotal region 12-4-1 and the translational region 12-4-2. Note that the shutter bearing 20-9 (or any other part of the shutter) is not pinned to the guide rail 12-4 (or any other part of the cover 12); thus, it is free to move within the pivotal region 12-4-1 disposed between the shutter catch 12-5 and the bend in the guide rail. The translational region 12-4-2 is thus approximately within the range of positions between the bend in the guide rail and the bottom of the guide rail 12-4.

When an object is inserted into the hot aperture 12-2, anti-probing wall 12-51 disengages from anti-probing slot 20-54 so that the far edge of 20-2 will disengage from stand-off elements 12-6. After the shutter rotates from the return position and into the hot blocking position, the return ribs 12-30 engage with gussets 20-7 (see FIG. 7A). In FIG. 7C, the shutter catches 12-5 are captured by the catch detents 20-8 formed in the neutral blocking surface 20-3. In the hot blocking position therefore, the single object is prevented from engaging the hot receptacle contact 14-2 by the anti-probing wall 12-20 and the shutter's hot blocking surface 20-2.

FIG. 7B shows an object being inserted into the neutral aperture 12-3. FIG. 7D shows the opposite cross sectional view of the resulting functionality of the device's structure per an object's insertion into the neutral aperture 12-3. When an object is inserted into the neutral aperture 12-3, bearing surfaces 20-9 engage their respective bends in the guide ribs 12-4 (see FIG. 7D). Each guide rail bend forms a pivot point that allows the shutter 20 to rotate when the bearing surfaces 20-9 engage their respective pivots (i.e., guide rail bends). The shutter rotates until its anti-probing slot 20-54 engages the anti-probing wall 12-51 and the far edge of 20-2 engages stand-off elements 12-6 (see FIG. 7B). Thus, the single object is prevented from engaging the neutral receptacle contact 14-3 by the anti-probing wall 12-10 and the shutter's neutral blocking surface 20-3.

As described and illustrated in the foreign object probing scenarios provided above, when the bearing surface 20-9 engages the guide rail bend, the shutter 20 cannot translate any significant distance in the x-direction (no relative movement to the left or right in FIGS. 7A-7D).

Note again that the pivot region 12-4-1 is so named because the bearings 20-9 may be displaced over this region, or range, simply because the bearing 20-9 is not fixed or pinned to the rail. There can be movement, therefore, of the shutter bearing 20-9 in the z-direction as it slides along the vertical portion of its respective guide rib 12-4 (between the return position and the guide rib bend in a blocking position). Stated differently, once the bearing surfaces 20-9 reach their respective guide rib bends, the shutter 20 stops moving in the z-direction and rotates into the blocking position. In one embodiment, the radiuses of the bearing surfaces 20-9 are substantially the same as the radiuses at the inside of each of the bends in the guide ribs 12-4.

In one embodiment, when a foreign object is inserted into either the hot receptacle aperture 12-2 or the neutral receptacle aperture 12-3 as described with respect to FIGS. 7A-D above, the object will strike blocking pad 20-2 or 20-3 and cause the shutter to rotate around the y-axis about 8° in one direction until the shutter is stopped in the manner described above. Thus, $-8° \leq \Delta R \leq +8°$, wherein AR denotes the approximate rotational limits of the shutter.

Figure 8A:
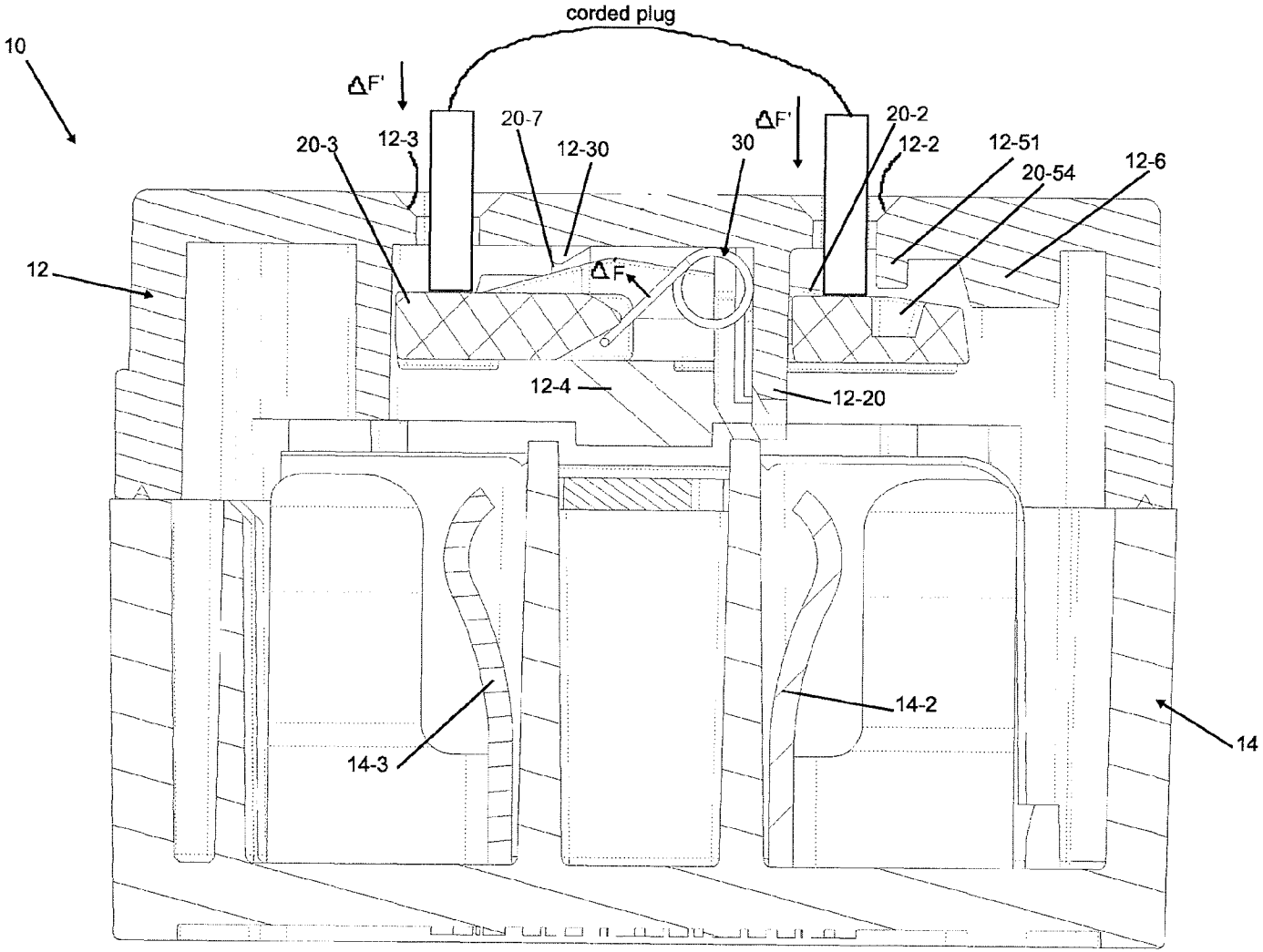
FIG. 8A-8C are cross sectional views of the shutter assembly with a corded plug blade assembly driving the shutter element along a translational portion of the guide structure to the open position in accordance with the present invention.
Figure 8B:
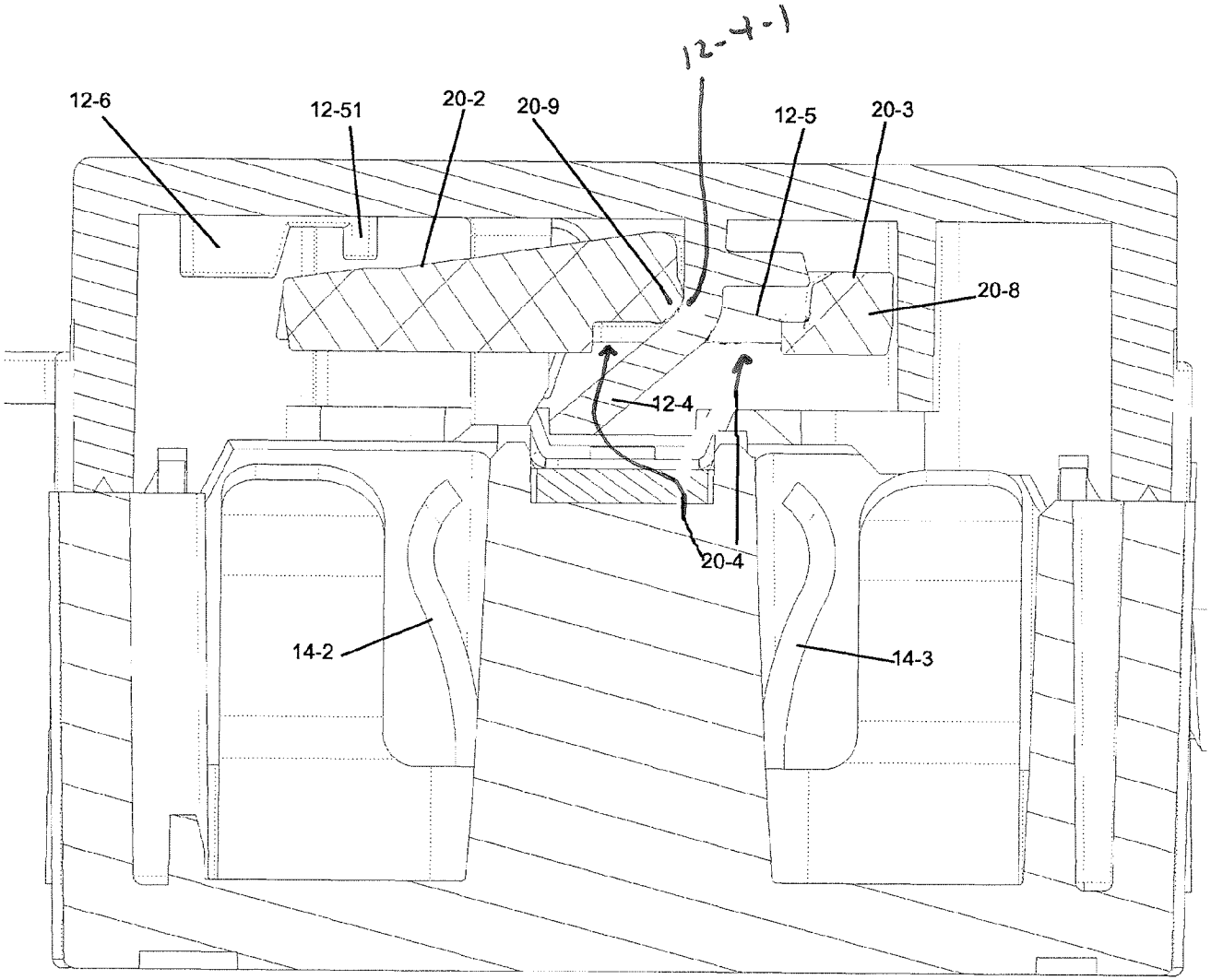
Figure 8C:
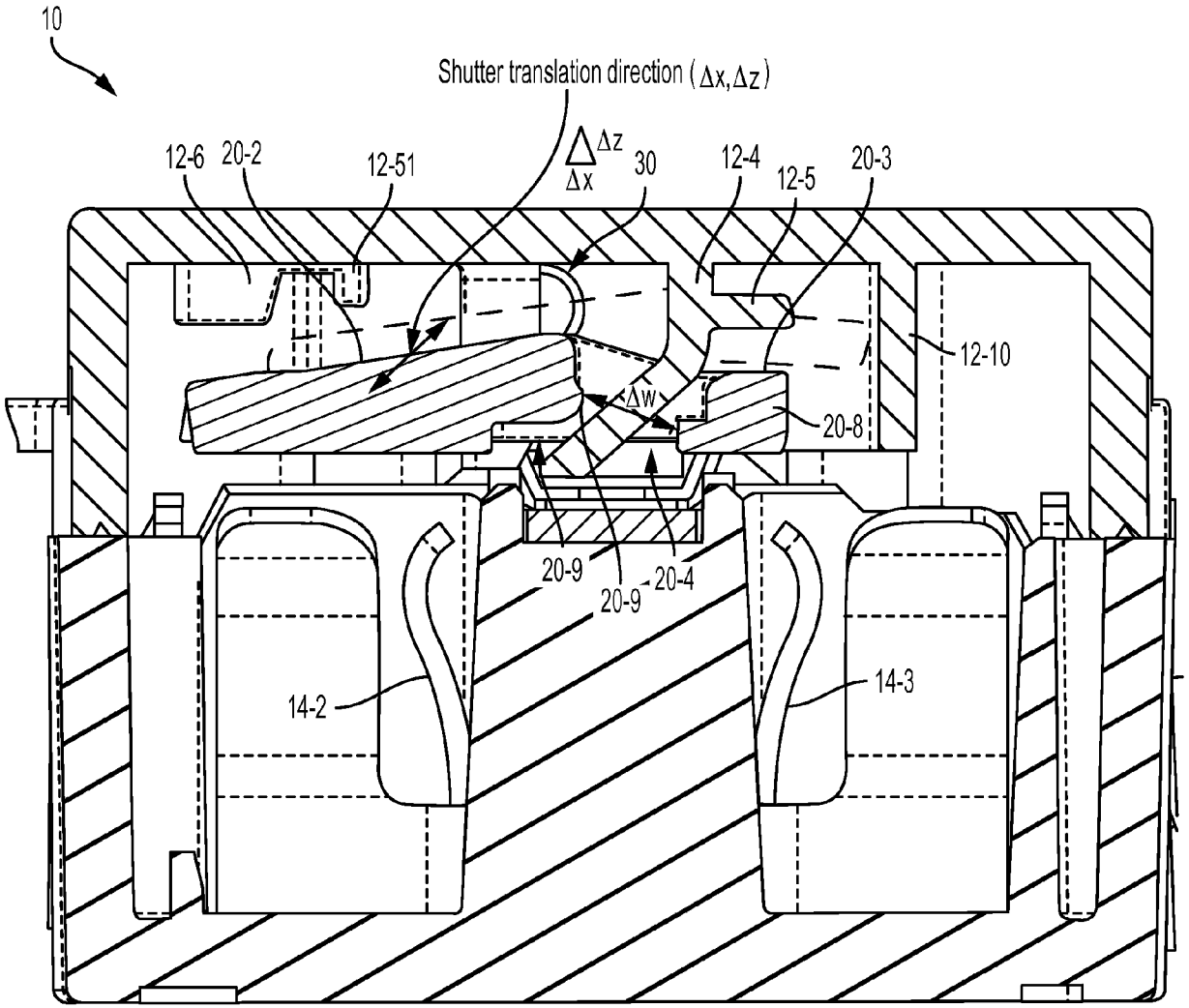
Figure 9A:
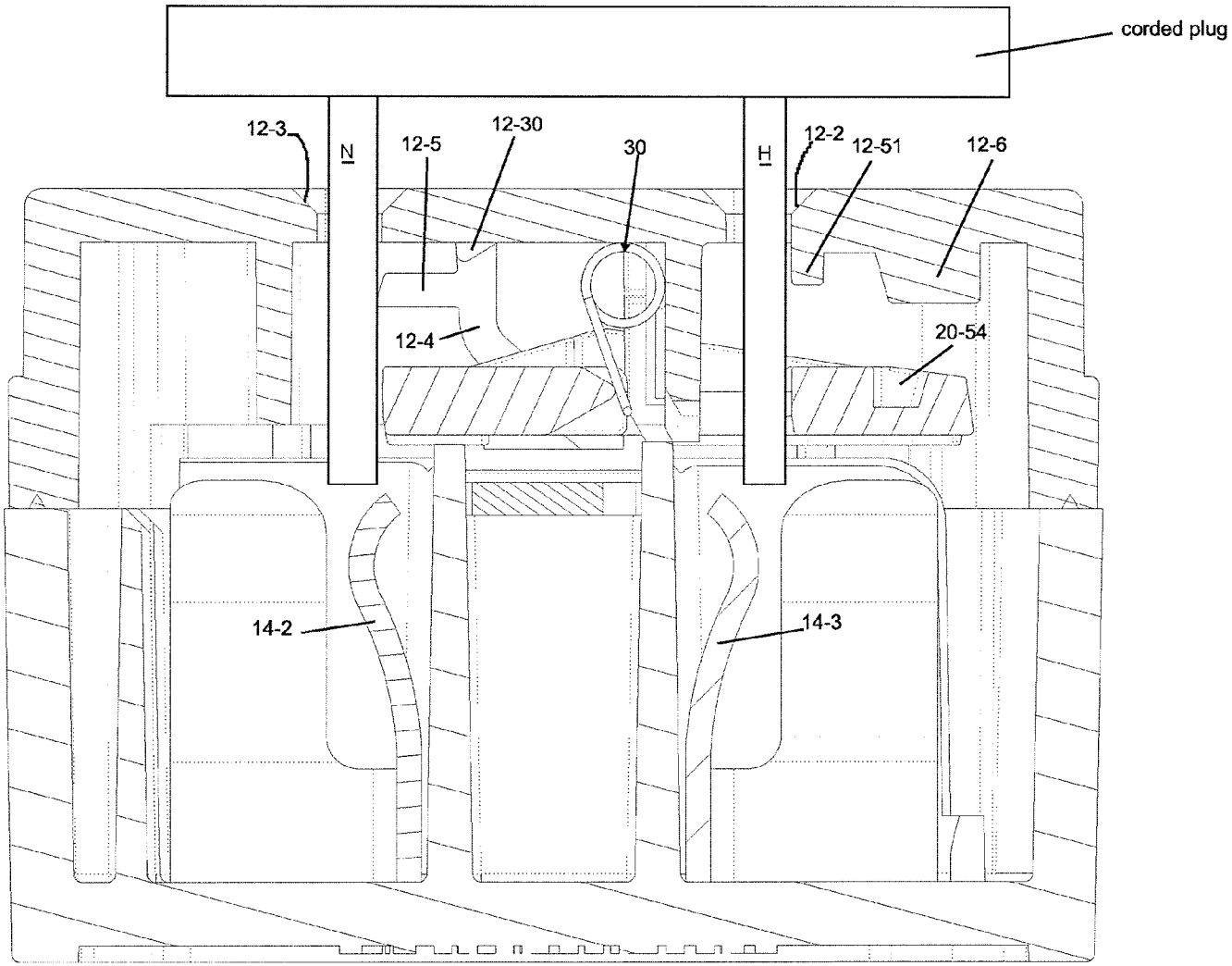
FIGS. 9A-9B are cross sectional views of the shutter assembly with a corded plug blade assembly fully inserted and the shutter element in an open position.
Figure 9B:
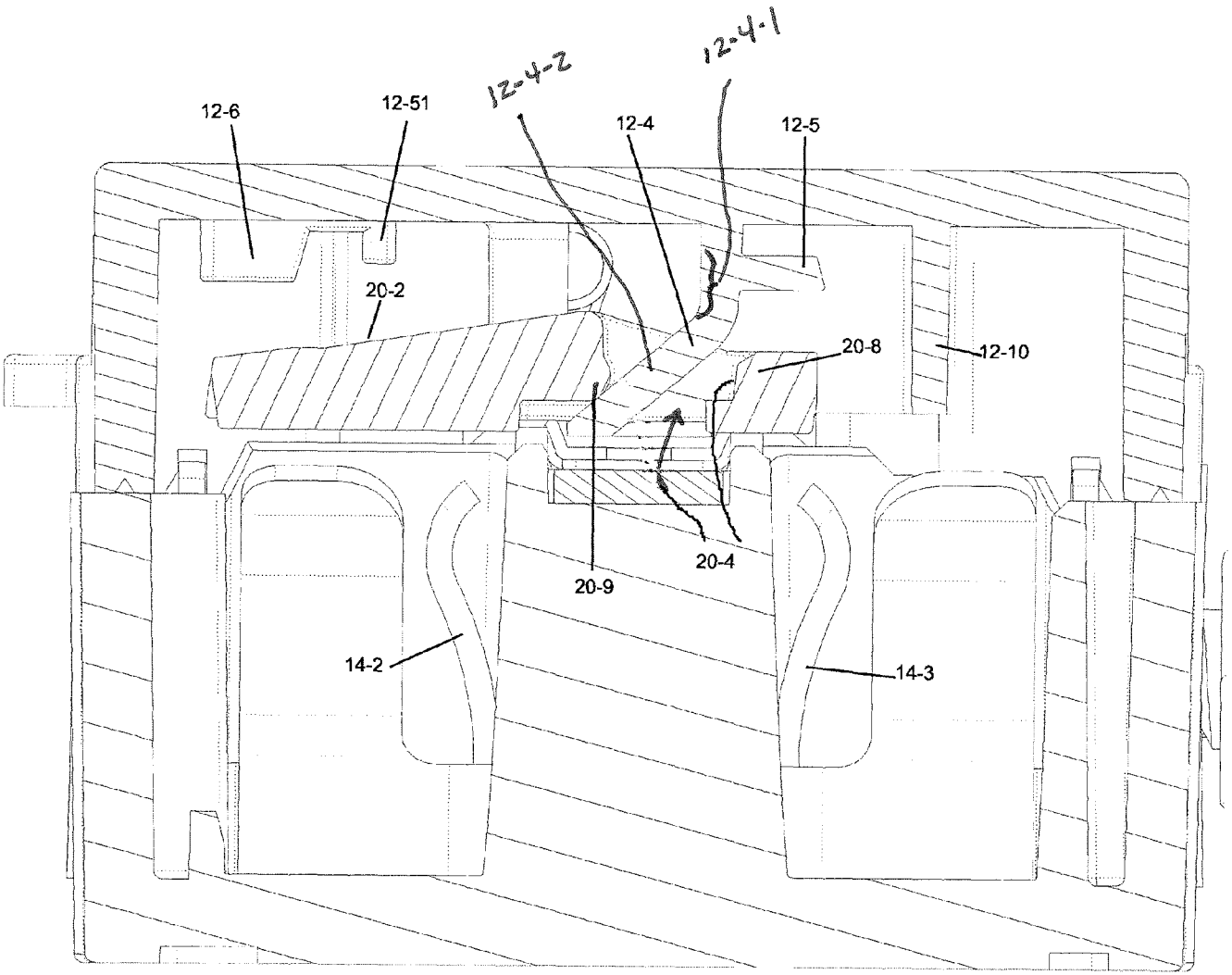

Referring to FIGS. 8A-8C, and 9A-9B, cross-sectional views are shown of the electrical wiring device 10 in the open position. FIGS. 8A and 9A are cross-sectional views of an electrical wiring device 10 taken along "A1" of the view illustrated in 5A. FIGS. 8B, 8C and 9B are cross-sectional views of an electrical wiring device 10 taken along "A2" of the view illustrated in 5A. As illustrated in these views, the shutter 20 is shown in various positions as it traverses the translational region 12-4-2 (i.e., the x and z movement from a return position to the open position).

In reference to FIG. 8A and FIG. 8B, a preliminary "unlocking" position is shown wherein the insertion of the corded plug blades has just begun; i.e., the shutter 20 has been moved by only a small distance. Specifically, when corded plug blades are inserted into apertures 12-2, 12-3 and overcome the force of the return spring 30, the shutter 20 starts to move in the x and z directions (guided by guide ribs 12-4) so that the gussets 20-7, catches 12-5, anti-probing wall 12-51, and the far edge of 20-3 separates from the return ribs 12-30, catch detents 20-8, anti-probing slot 20-54, and the stand-off elements 12-6, respectively. Moreover, the bearings 20-9 are directed down the vertical portion of the guide rails, through the guide rail bends and down the translational portion 12-4-2 of the guide ribs 12-4. Once this occurs, the shutter 20 opens and allows the corded plug blades to engage the respective contacts 14-2, 14-3. When the plug blades are removed, the return spring 30 is structured and configured to reverse the above described movement until the shutter 20 is returned to the return position as shown and described with respect to FIG. 6.

In reference to FIG. 8C, a cross-sectional view of an electrical wiring device 10 showing the shutter 20 in the translational region 12-4-2 (described above) is disclosed. Again, as the hot and neutral blades press shutter 20 downwardly, the shutter 20 may remain substantially parallel to the front cover while it moves generally to the left in the x-direction. In this view, the width ($\Delta W$) of the opening 20-4 is seen to be much greater than the thickness of the guide rib 12-4. Again, this clearance allows the shutter 20 to wobble, or move back and forth about the guide rib 12-4 as it traverses the translational region 12-4-2.

In conventional shutter mechanism designs, the assumption is that the keyed receptacle openings force the plug blades to be inserted into the receptacle openings simultaneously. While this is true to a certain extent, there is still a great deal of room for skewing and side-to-side movement until the blades are captured by the receptacle contacts. For example, when a person attempts to insert a corded plug into a receptacle opening, he/she very often wiggles the plug in an effort to align the plug blades with the cover apertures. These back and forth skewing movements cause the plug blades to strike the shutter with varying amounts of force at different instants of time (not simultaneously). Similar issues can be caused by plug blades that are bent or not of the same length. Conventional shutters typically employ a linear slide motion and become jammed and inoperative after they absorb repeated nicks and gouges. The present invention seeks to address this issue by allowing the shutter 20 to freely float in the return position and as it traverses the various portions/regions of the guide rail 12-4. Accordingly, the counter-intuitive wobbling motion prevents damage to the shutter during plug insertion.

FIGS. 9A-9B are cross sectional views of the shutter 20 in an open position with corded plug blades fully inserted. In this view, the return spring 30 is in compression within the device 10 and the bearing surface 20-9 is shown at a bottom potion of the translational region 12-4-2 on the guide rib 12-4.

Turning to the embodiment of FIGS. 10-19, an alternative spring (compression spring 30') and shutter 20' arrangement is disclosed. This embodiment also includes a guide rail 12-4 that features a pivotal region 12-4-1 and a translational region 12-4-2. When the shutter 20 is disposed in the pivotal region 12-4-1, the shutter may be in the return position, a hot blocking position or a neutral blocking position. When the shutter 20 is disposed in the translational portion 12-4-2 of the guide rail 12-4, the shutter is in, or moving to, the open position. As before, the pivot region 12-4-1 is so named because the bearings 20-9 may slide over this region during movements between the return position and one of the blocking positions. Again, this movement occurs or can occur because the bearing 20-9 is not fixed or pinned to the rail. There can be movement, therefore, of the shutter bearing 20-9 in the z-direction as it slides along the vertical portion of its respective guide rib 12-4 (between the return position and the guide rib bend in a blocking position). Once the bearing 20-9 engages the bend in the guide rail 12-4, the movement stops and the shutter rotates into a blocking position.

Figure 10:
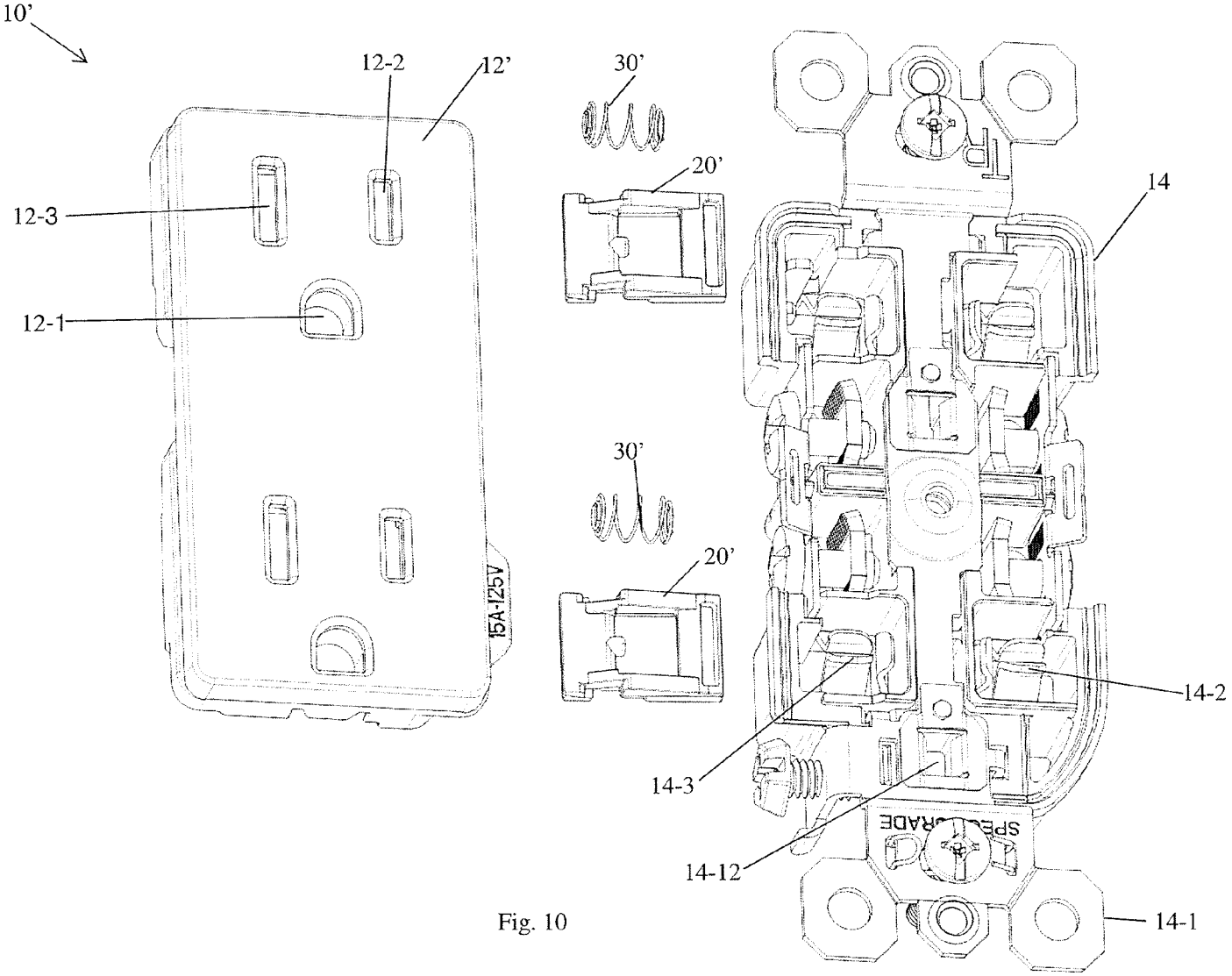
FIG. 10 is a perspective view of an electrical device with the front cover and the shutter assemblies removed in accordance with an alternative embodiment.

Referring to FIG. 10, a perspective view of an electrical device 10' with a front cover 12' and the shutter assemblies removed is shown in accordance with an alternative embodiment. FIG. 10 is similar to FIG. 1. One difference between FIG. 10 and FIG. 1 is the use of dual compression springs 30' instead of the dual torsion springs 30 (as shown in FIG. 1). The compression springs 30' and the torsion springs 30 are configured to apply different kinds of forces and thus operate the shutters differently. The modified shutters 20' are described in further detail below with respect to FIGS. 13A and 13B.

Figure 11:
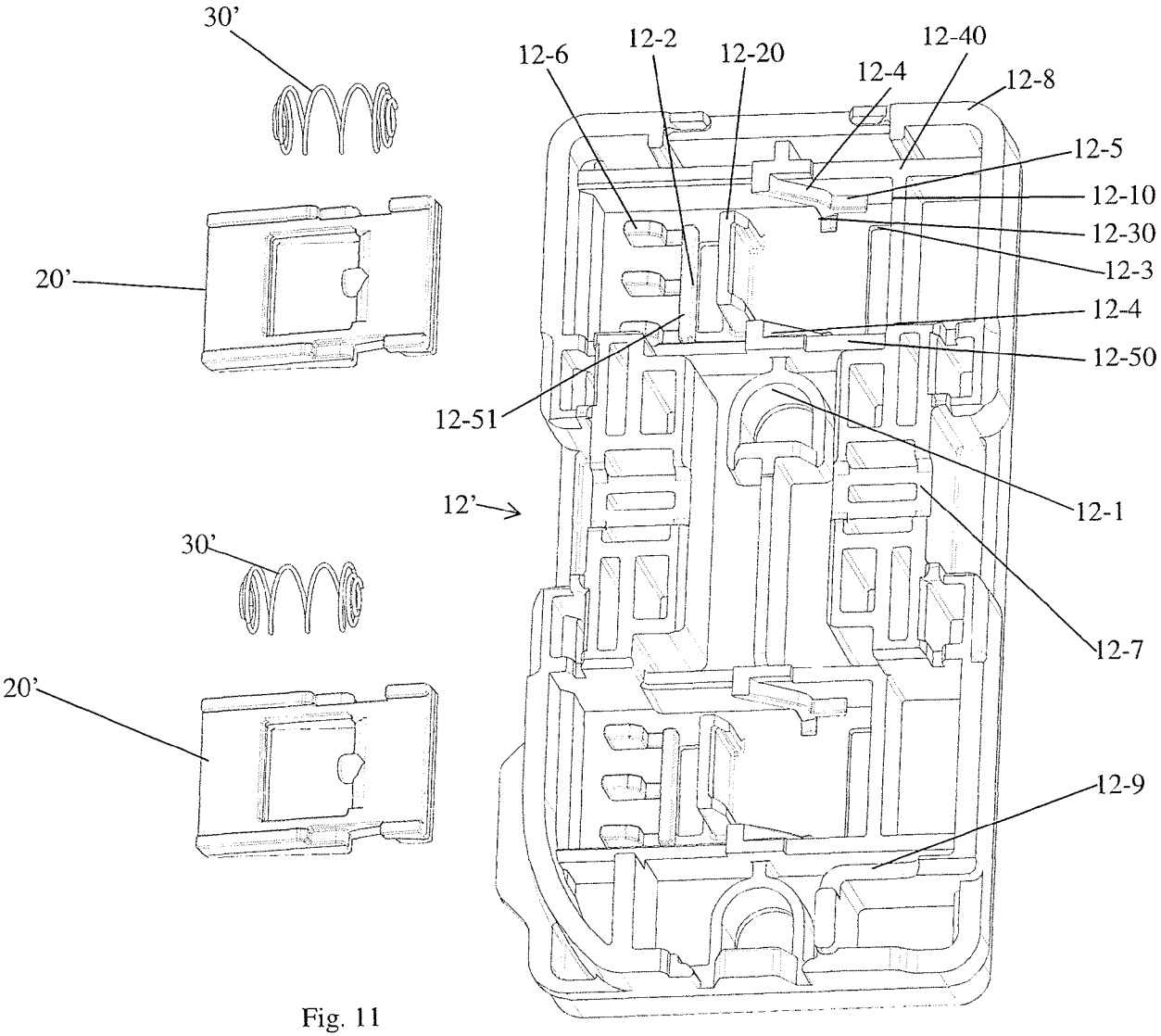
FIG. 11 a perspective view of an interior of the front cover and the shutter assemblies depicted in FIG. 10.

In reference to FIG. 11, the two piece alternative shutter assembly—including the shutters 20' and their corresponding compression springs 30'—are shown prior to being inserted into the rear portion of the cover 12'. FIG. 11 is similar to FIG. 2; however, there are some differences. In addition to showing the alternative shutter assembly, this embodiment does not include the snap-in ("spring catch") elements 12-22 of cover 12 that are shown in FIG. 2. The snap-in elements 12-22 are helpful in maintaining the retention portions 30-1 of the torsion springs 30 in a static position. However, such snap-in elements 12-22 are not necessary with the use of compression springs 30'. As such, this alternative embodiment can save on manufacturing costs (i.e., the step of forming the snap-in elements 12-22 can be avoided). As before, the shutter 20 and the spring 30 do not form a module (i.e., they do not form a unit that can be installed in the cover 12). They are installed in the cover separately.

Figure 12A:
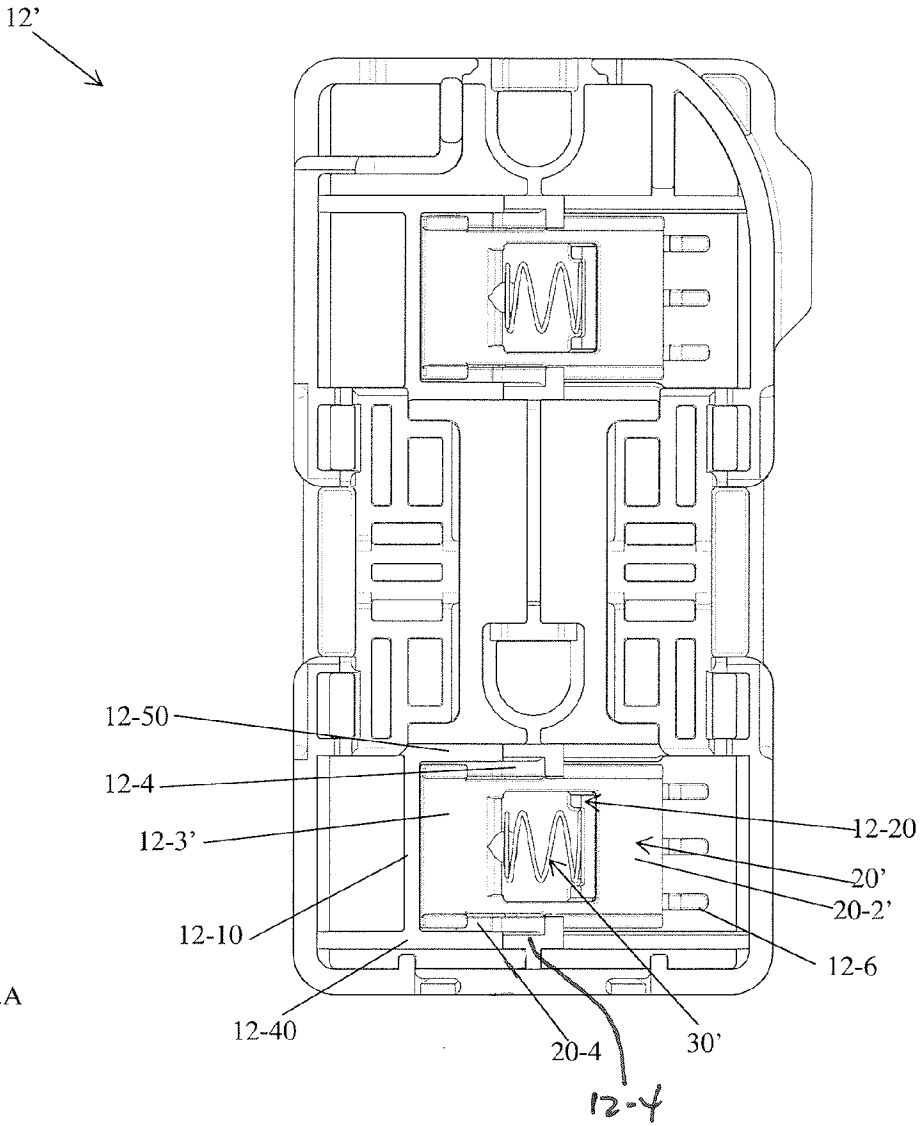
FIGS. 12A-12B are perspective views of an interior of the front cover with the shutter assemblies installed in accordance with the alternate embodiment depicted in FIG. 10.
Figure 12B:
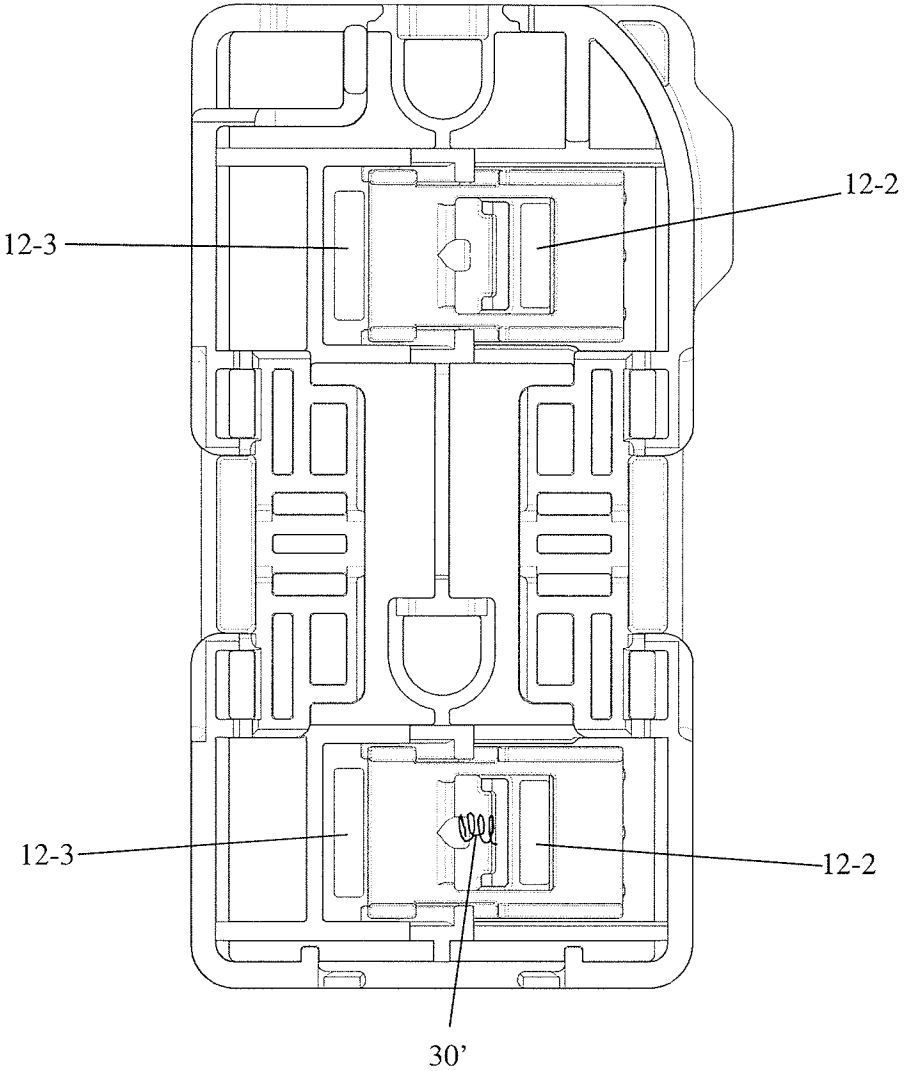

Referring to FIGS. 12A and 12B, the two piece alternative shutter assembly (20', 30') is shown coupled to the interior portion of the cover 12'. FIGS. 12A and 12B are similar to FIG. 3 with some differences. More specifically, FIG. 12A shows the shutters 20 in a return position (where the compression springs 30 apply a small force to the shutters 20 to maintain the shutters 20 in the "return" position). When a foreign object (e.g., a "bobby pin") is inserted into either the hot or the neutral position, the shutter is rotated into a blocking position so that the object cannot access the set of hot and neutral plug blade openings (12-2 and 12-3, respectively).

Thus, the shutter assembly of the present invention features four shutter positions (return, blocking (hot and neutral) and open) that correspond to two guide rail regions (pivotal region 12-4-1 and translational region 12-4-2).

FIG. 12B shows the shutters 20' in an "open" position (where a corded plug (not shown) has been inserted to actuate the shutters 20' to such a position in a similar manner as described above with respect to shutters 20).

Figure 13B:
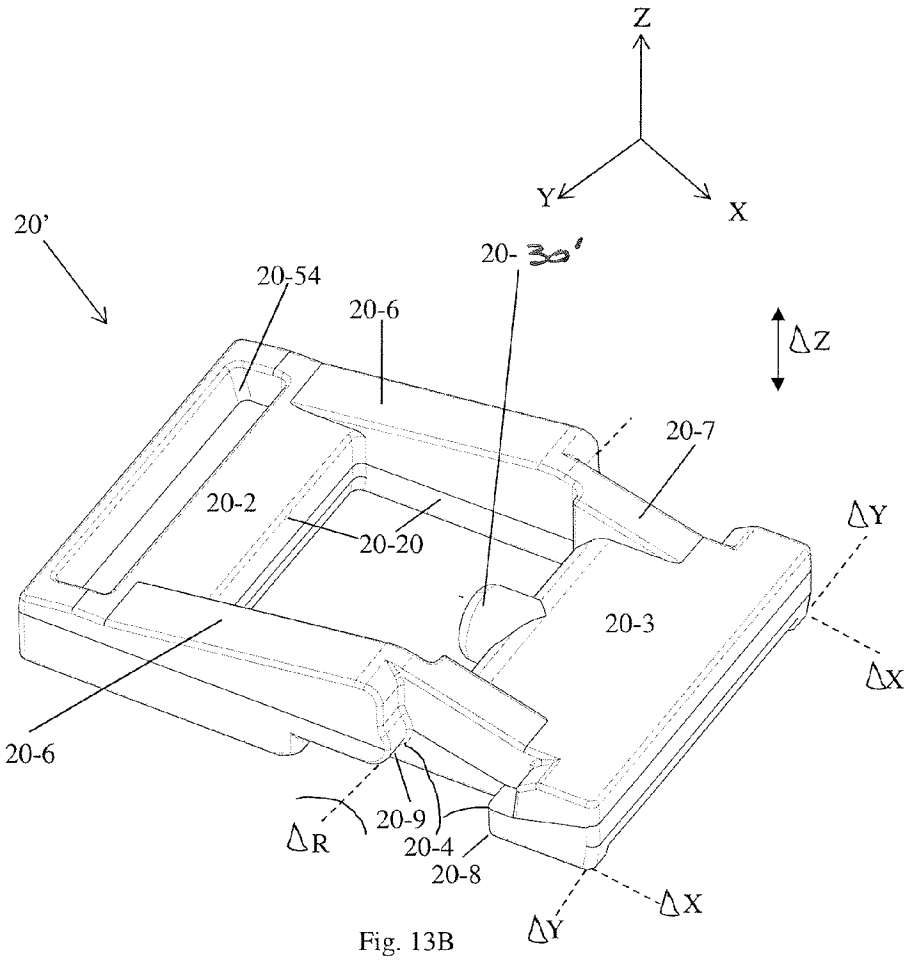
FIGS. 13A-13B are perspective views showing an underside and a topside, respectively, of the shutter element depicted in FIG. 10.
Figure 13A:
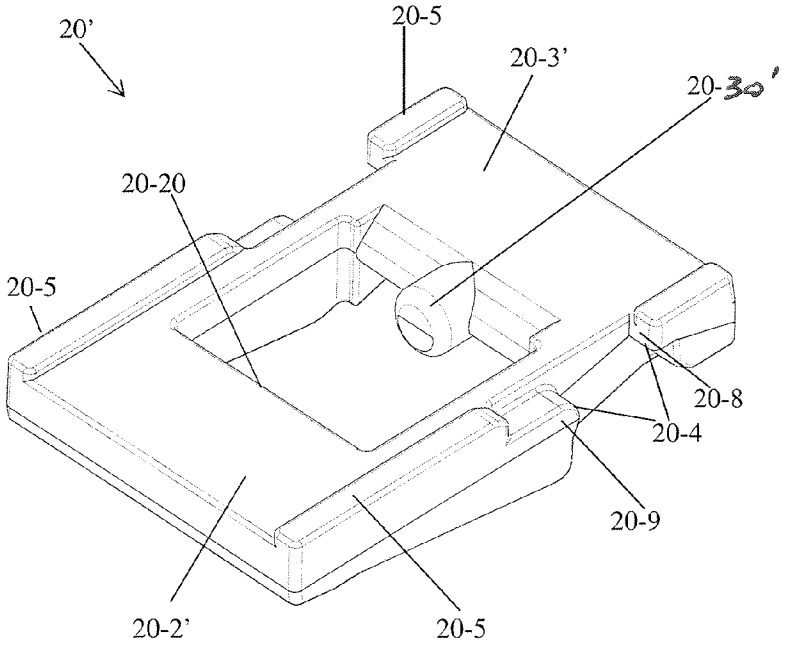

Turning to FIGS. 13A and 13B, isometric detail views of the shutter 20' are provided. FIGS. 13A and 13B are similar to FIGS. 4A and 4B, respectively, with some differences. FIGS. 13A and 13B do not include an interior gusset 20-11 as shown in FIGS. 4A and 4B. Instead, FIGS. 13A and 13B include a spring mount 20-30' that is configured to accommodate one end of compression spring 30' (i.e., spring mount 20-30' is configured to fit within the diameter of an end of the compression spring 30' when the compression spring 30' is placed within the opening 20-20 of the shutter 20' to create the two piece shutter assembly (20', 30')).

Figure 14A:
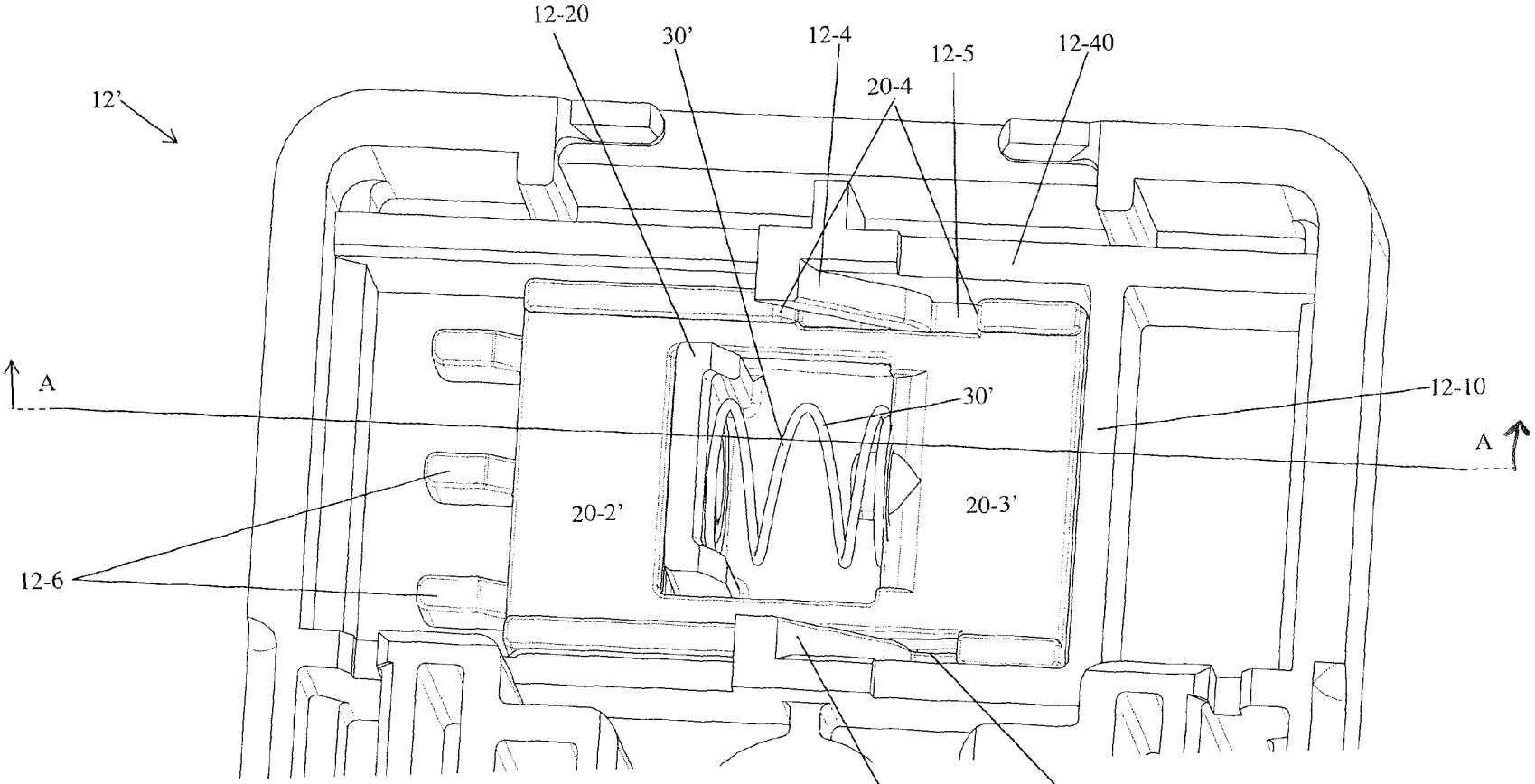
FIGS. 14A-14B are detail views showing an interior of the front cover with an installed shutter assembly in a return position and in an open position, respectively, in accordance with the alternate embodiment depicted in FIG. 10.
Figure 14B:
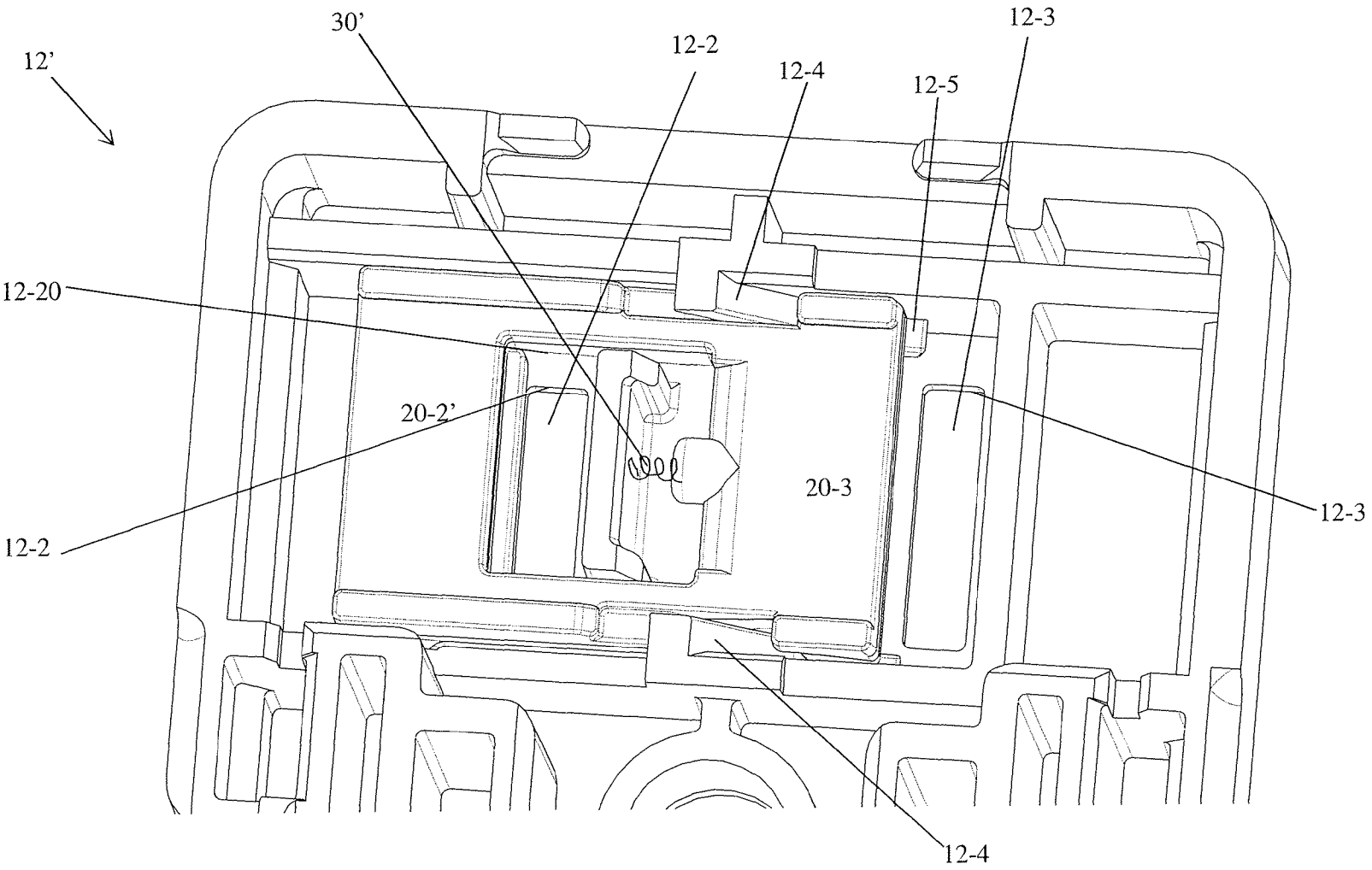

Referring to FIGS. 14A and 14B, in situ detail views of the underside of shutter 20' in the return and in open positions, respectively, are shown. FIGS. 14A and 14B are similar to FIGS. 5A and 5B, respectively, with the same previously described differences. As shown in FIG. 14A, the compression spring 30' applies a small force to the shutter 20' in the x-direction (to the right) such that the shutter 20' is in the return position (as opposed to applying a small force to the shutter 20 toward the interior surface of the front cover 12, as shown and described with respect to FIG. 5A).

Figure 15:
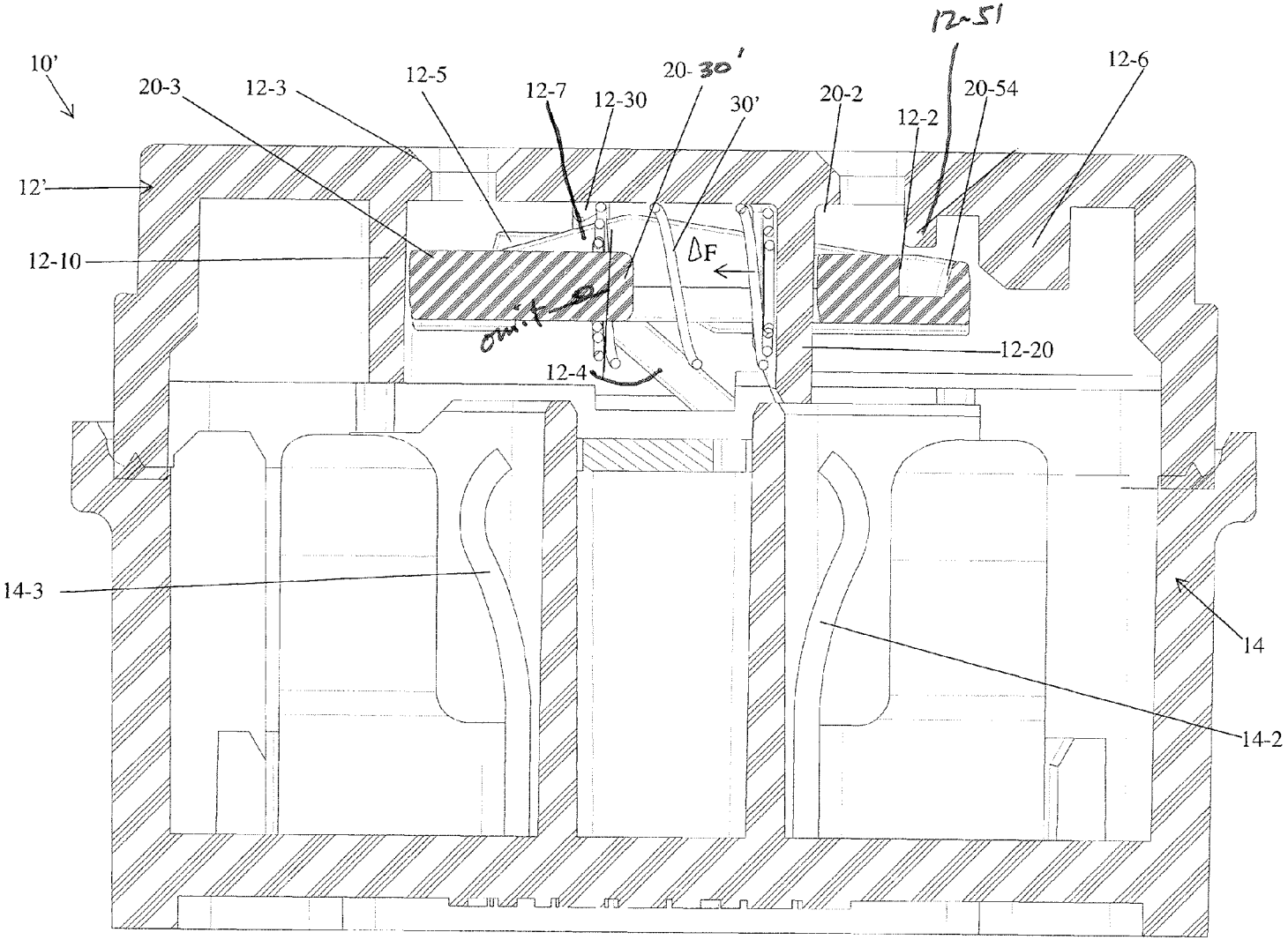
FIG. 15 is a cross sectional view of the shutter assembly in a return position in accordance with the alternate alternative embodiment depicted in FIG. 10.

Turning to FIG. 15, a cross-sectional view of an electrical wiring device 10' taken along section A (FIG. 14A) is shown, with the shutter 20' in the return position. The embodiment shown in FIG. 15 is similar to the embodiment shown in FIG. 6, with some differences. During assembly, the spring 20' is employed to position the shutter 20' in the return position per a translational force "F" of approximately 100-200 grams. In particular, the spring 30' applies a force in the x-direction (to the left) to maintain the shutter 20' in the return position. The direction of the force being applied by the compression spring 30' is different than the direction of the force being applied by the torsion spring 30 (which applies a translational force in the z-direction (up), as shown and described with respect to FIG. 6).

Another difference between the embodiment of FIG. 6 and the embodiment of FIG. 15 relates to the shutter's disposition in the return position. As shown in FIGS. 4A-4B, the shutter element 20 is shown to include lateral rib portions (20-6, 20-7) that are on either side of the shutter major surface (20-2, 20-3). In FIG. 6, the lateral ribs (20-6, 20-7) prevent the blocking surfaces (20-2, 20-3) from abutting the interior surface of the front cover 12 when the shutter assembly is disposed in the return position. In other words, the rib portions function as stand-offs in the return position. In the embodiment of FIG. 15, no part of the shutter 20 touches the interior surface of the front cover 12. Instead, the actual position of shutter 20 is substantially random in the return position, in that it can be and move within an approximate range of +/−8° about a plane parallel to the front cover in the return position. Stated in another way, if one were to insert a foreign object into aperture 12-3, for example, the shutter would rotate. As the foreign object is inserted further, the shutter would continue to rotate until it reaches the blocking position; at that point, the shutter 20 would stop rotating. Thus, the return position is separate and distinct from the blocking positions.

Figure 16:
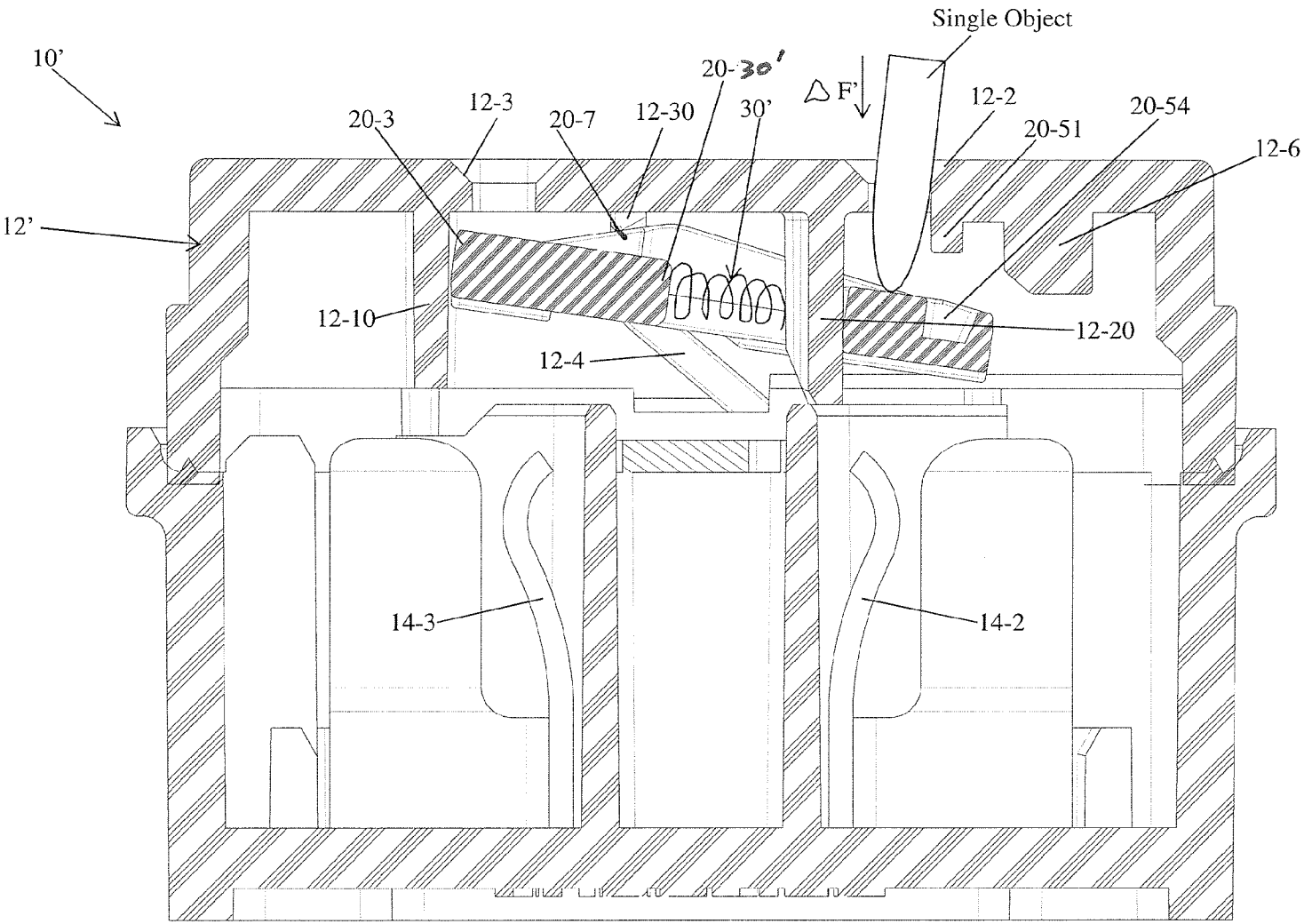
FIGS. 16 and 17 are cross sectional views of the shutter assembly in a "blocking" position in accordance with the alternate embodiment depicted in FIG. 10.
Figure 17:
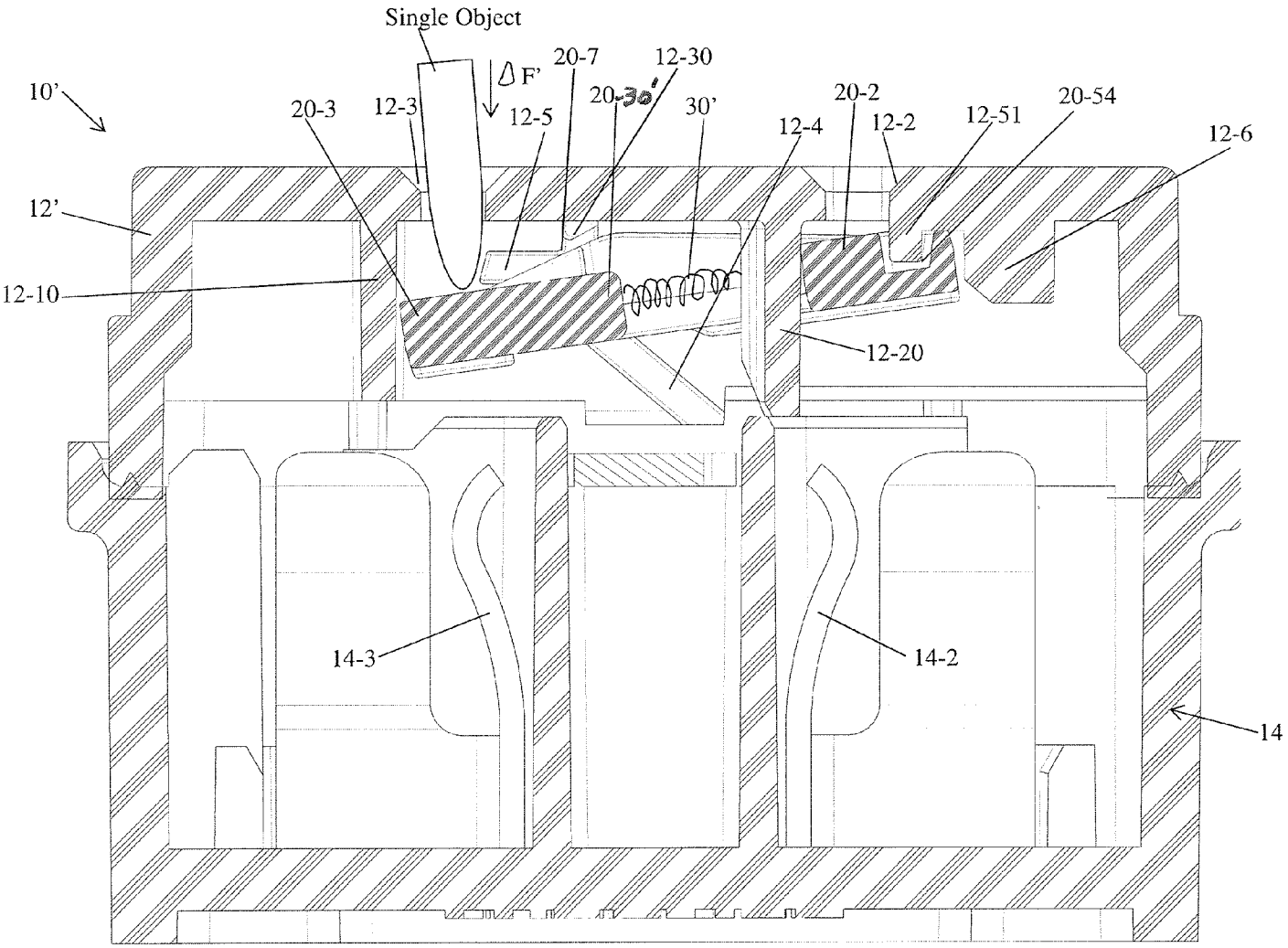

Referring to FIGS. 16 and 17, cross sectional views of the electrical wiring device 10' taken along sectional A (FIG. 14A) are shown. FIGS. 16 and 17 illustrate the functionality of the shutter 20', spring 30' and cover 12' when a single foreign object is inserted into only one of the cover apertures 12-2, 12-3 and exerts an external force "F'" on shutter 20'. In these views, the shutter 20' is rotated into a "blocking" position preventing a single foreign object from engaging the hot receptacle contact 14-2 (FIG. 16) and the neutral receptacle contact 14-3 (FIG. 17). FIGS. 16 and 17 are similar to FIGS. 7A and 7B, respectively, with the same previously described structural differences. As described with respect with FIGS. 7A and 7B (among other similar functionalities), there is no significant movement of the shutter 20' in the x-direction (no relative movement to the left or right) in FIGS. 16 and 17.

Figure 18:
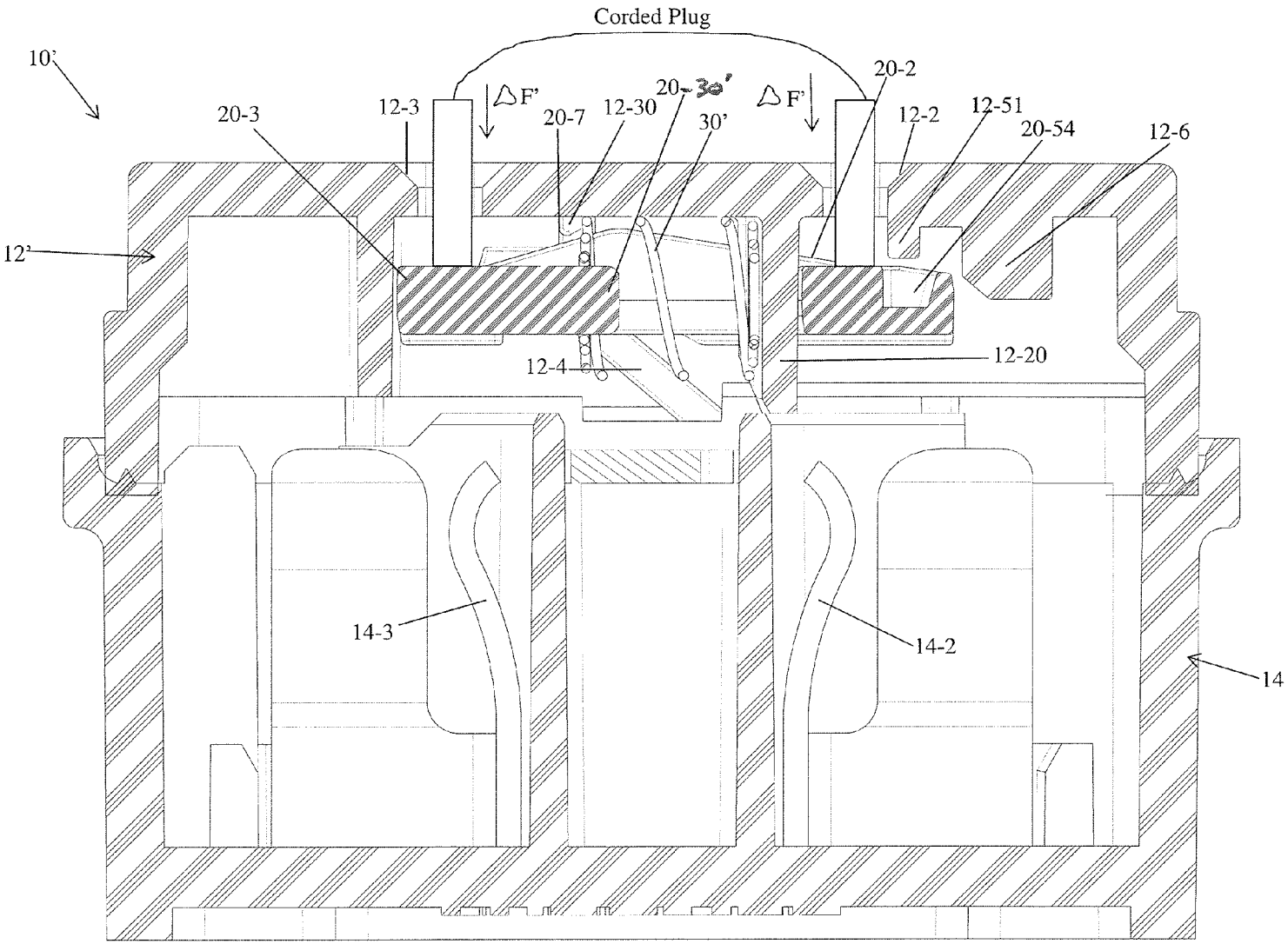
FIG. 18 is a cross sectional view of the shutter assembly with a corded plug blade assembly driving the shutter element along a translational portion of the guide structure to the open position in accordance with the alternate embodiment depicted in FIG. 10.

Turning to FIG. 18, a cross section view of the electrical wiring device 10' taken along "A1" of the view illustrated in FIG. 14A is shown. FIG. 18 is similar to FIG. 8A, and illustrates the functionality of the shutter 20', spring 30' and cover 12' when corded plug blades are inserted into the cover apertures 12-2, 12-3 and exert an external force "F'" overcoming the force "F" exerted by compression spring 30'. In this view, the shutter 20' is shown at the beginning (preliminary "unlocking" position) of its x and z direction movement (from a return position toward an eventual corded plug blade fully deployed/actuated position shown in FIG. 19) guided by guide ribs 12-4 to the shutter's 20' final full corded plug actuation position, which exposes hot contact 14-2 or neutral contact 14-3 for contact with the corded plug. If the corded plug blades are removed, the compression spring 30' is structured and configured to move (via force F in the x-direction—to the left) the shutter 20' back to the return position as shown and described with respect to FIG. 15.

Figure 19:
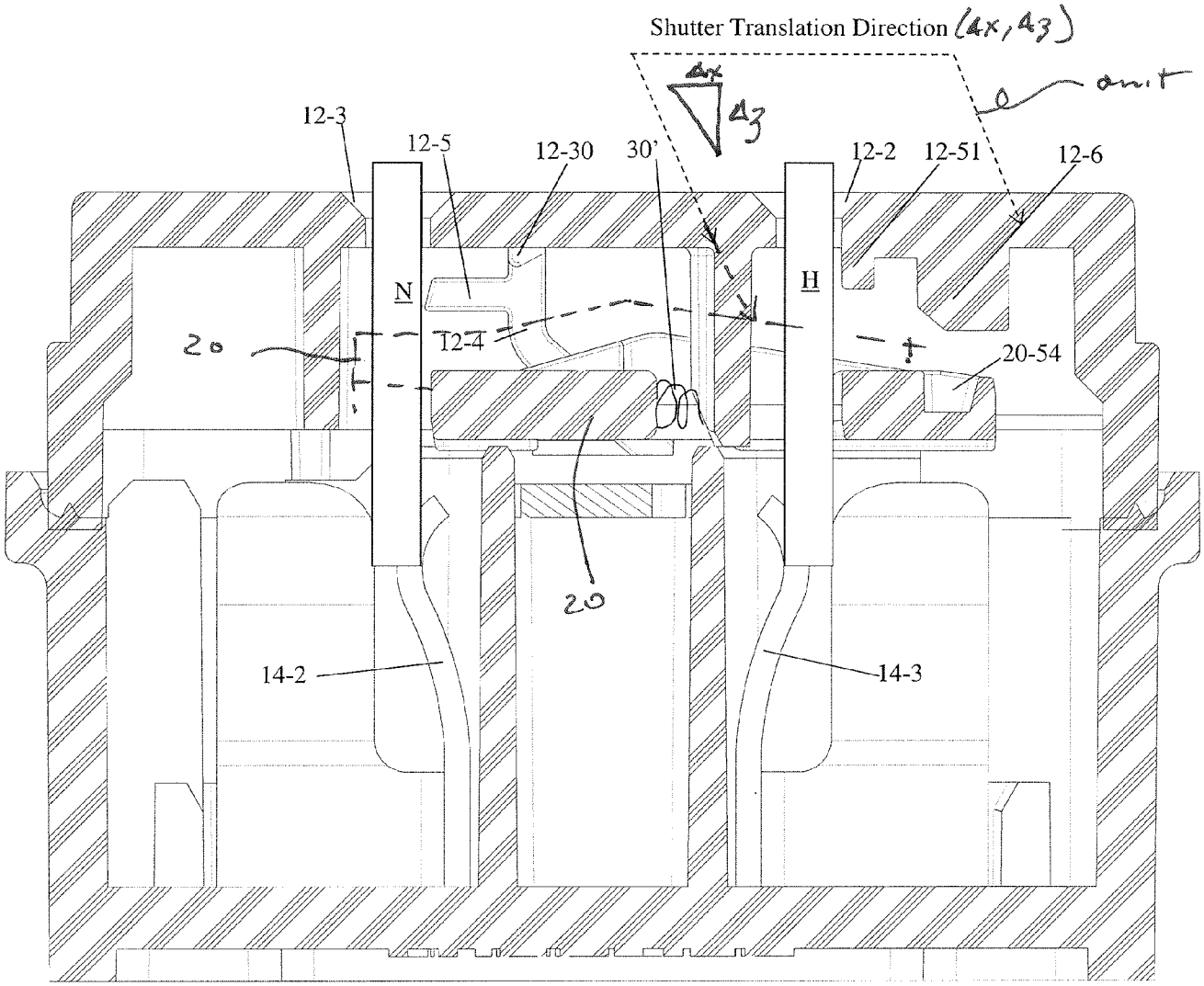
FIG. 19 is a cross sectional view of the shutter assembly with a corded plug blade assembly fully inserted and the shutter element in an open position in accordance with the alternate embodiment depicted in FIG. 10.

Referring to FIG. 19, a cross section view of the electrical wiring device 10' taken along "A1" of the view illustrated in FIG. 14A is shown. FIG. 19 is similar to FIG. 9A, and shows a corded plug blade in a fully deployed/actuated position with the hot blade "H" and the neutral blade "N" of the corded plug making contact with the hot contact 14-2 and neutral contact 14-3, respectively. The movement of the plug blades causes the shutter 20' to move down the guide ramp 12-4 (as described above) and compress the compression spring 30' to its full compressed position within the device 10'. Once the corded plug blade is removed, the compression spring 30' force F allows the shutter 20' to move up along the guide ramp 12-4 and back to the return position as shown and described with respect to FIG. 15.

Accordingly, when a corded plug is inserted into the cover apertures 12-2, 12-3, the applied forces are more than enough to overcome the spring force of compression spring 30', as discussed above. As described with other embodiments herein, this alternative embodiment allows for a side-to-side translation of the shutter in the x-z plane to the open position.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. There is no intention to limit the invention to the specific form or forms disclosed, but on the contrary, the intention is to cover all modifications, alternative constructions, and equivalents falling within the spirit and scope of the invention, as defined in the appended claims. It is, therefore, to be understood that the foregoing embodiments are presented by way of example only and that, within the scope of the appended claims and equivalents thereto; inventive embodiments may be practiced otherwise than as specifically described and claimed.

All references, including publications, patent applications, and patents, cited herein are hereby incorporated by reference to the same extent as if each reference were individually and specifically indicated to be incorporated by reference and were set forth in its entirety herein.

All definitions, as defined and used herein, should be understood to control over dictionary definitions, definitions in documents incorporated by reference, and/or ordinary meanings of the defined terms.

The use of the terms "a" and "an" and "the" and similar referents in the context of describing the invention (especially in the context of the following claims) are to be construed to cover both the singular and the plural, unless otherwise indicated herein or clearly contradicted by context.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An electrical device comprising:

a housing including a front cover coupled to at least one body member, the front cover including a plurality of receptacle openings in a major front surface thereof, the plurality of receptacle openings being configured to receive a plurality of plug blades of a corded electrical plug, the at least one body member including at least one set of receptacle contacts including a hot receptacle contact and a neutral receptacle contact configured to mate with the plurality of plug blades when the corded electrical plug is inserted into the plurality of receptacle openings;

a set of electrical terminations accessible via at least one aperture in the housing, the at least one set of receptacle contacts being configured to receive electrical power from the at least a portion of the set of electrical terminations;

a guidance structure corresponding to the at least one set of receptacles coupled to the front cover, the guidance structure including a first guidance portion and a second guidance portion; and a shutter assembly including a shutter element coupled to the first guidance portion in a return position when not engaged by an object and rotatable about the first guidance portion via engagement with the first guidance portion from the return position to a shutter blocking position in response to being engaged by an object via one of the plurality of receptacle openings, the object being prevented from obtaining access to the at least one set of receptacle contacts in the blocking position, the shutter element being translated from the return position on and along the first guidance portion to an open position on the second guidance portion in response to being engaged by the plurality of plug blades via the plurality of receptacle openings, the shutter being coupled to the guidance structure so that the shutter rotationally self-aligns to the plurality of plug blades when the shutter element is translated from the return position to the open position wherein the plurality of plug blades are allowed to mate with the hot receptacle contact and the neutral electrical contact, respectively.

2. The device of claim 1, wherein the shutter element is configured to rotationally self-align with end portions of the plurality of plug blades in response to an asymmetry in respective lengths of the plurality of plug blades.

3. The device of claim 1, wherein the guidance structure includes a first rail and a second rail configured to couple the shutter element therebetween, each of the first rail and the second rail including a first rail portion extending from an interior major surface of the front cover in a substantially perpendicular direction to a pivot position to form the first guidance portion, each of the first rail and the second rail further including a second rail portion extending from the pivot position at a predetermined angle relative the first rail portion to form the second guidance portion.

4. The device of claim 3, wherein the predetermined angle is greater than about thirty five degrees.

5. The device of claim 1, wherein the shutter element includes a first major surface disposed on one side thereof and configured to be engaged by the plurality of plug blades, the shutter element further including a second major surface disposed on a second side thereof, the first major surface being substantially parallel to the second major surface.

6. The device of claim 1, wherein the shutter element includes a first major surface configured to be engaged by the plurality of plug blades, the shutter element further including a first lateral rib portion disposed at a first edge of the first major surface and a second lateral rib portion disposed at a second edge of the first major surface parallel to the first edge, the first lateral rib portion and the second lateral rib portion being configured to prevent the first major surface from abutting an interior major surface of the front cover when the shutter assembly is disposed in the return position.

7. The device of claim 6, wherein the shutter element is configured to move from the return position to the translational portion via the pivot position when the shutter element is engaged by the plurality of plug blades.

8. The device of claim 1, wherein the guidance structure is configured as a yoke structure, the yoke structure including a first railed bearing portion substantially disposed in parallel with a second railed bearing portion.

9. The device of claim 8, wherein the shutter element includes a first lateral opening and a second lateral opening configured to be coupled to the yoke structure, the first lateral opening including a first substantially radial bearing interface and the second lateral opening including a second substantially radial bearing interface configured to ride the first railed bearing portion and the second railed bearing portion, respectively, from substantially the return position to the open position in response to being engaged by the plurality of plug blades.

10. The device of claim 1, wherein the shutter element includes an aperture configured to allow one of the plurality of plug blades to pass through in the open position.

11. The device of claim 1, wherein the shutter element includes a seat portion configured to accommodate a spring, the spring being disposed between the seat portion and an anti-probing portion of the front cover.

12. The device of claim 11, wherein the spring is selected from a group of springs that include a torsion spring or a compression spring.

13. The device of claim 1, wherein the guidance structure is an integrally molded feature of an interior surface of the front cover.

14. The device of claim 1, wherein the housing includes a wiring device housing, a duplex receptacle housing, a decorator housing, an extension cord housing, a multiple outlet strip housing, a combination receptacle and switch housing.

15. The device of claim 1, further including a protection circuit, a ground fault circuit interrupter, an arc fault circuit interrupter, or a surge protective device.

16. An electrical device comprising:

a housing including a front cover coupled to at least one body member, the front cover including a plurality of receptacle openings in a major front surface thereof, the plurality of receptacle openings being configured to receive a hot plug blade and a neutral plug blade of a corded electrical plug, the at least one body member including at least one set of receptacle contacts including a hot receptacle contact and a neutral receptacle contact configured to mate with the hot plug blade and a neutral plug blade, respectively, when the corded electrical plug is inserted into the plurality of receptacle openings;

a set of electrical terminations accessible via at least one aperture in the housing, the at least one set of receptacle contacts being configured to receive electrical power from the at least a portion of the set of electrical terminations;

a railed guidance structure corresponding to the at least one set of receptacle contacts coupled to the front cover; and a shutter assembly including a shutter element having an interface portion coupled to the railed guidance structure so that the shutter element rides the railed guidance structure from a return position to an open position in response to being engaged by the plurality of plug blades, the interface portion and the railed guidance structure being configured to allow the shutter element to rotationally align with end portions of the plurality of plug blades in response to an asymmetry in respective lengths of the plurality of plug blades, the open position permitting electrical engagement of the plurality of plug blades with the plurality of receptacle contacts, the shutter element being directed from the return position to a blocking position in response to being engaged by an object via at least one of the plurality of receptacle openings to prevent the object from obtaining access to the at least one set of receptacle contacts.

17. The device of claim 16, wherein the shutter element includes a first major surface disposed on one side thereof and configured to be engaged by the plurality of plug blades, the shutter element further including a second major surface disposed on a second side thereof, the first major surface being substantially parallel to the second major surface.

18. The device of claim 16, wherein the shutter element includes a first major surface configured to be engaged by the plurality of plug blades, the shutter element further including a first lateral rib portion disposed at a first edge of the first major surface and a second lateral rib portion disposed at a second edge of the first major surface parallel to the first edge, the first lateral rib portion and the second lateral rib portion being configured to prevent the first major surface from abutting an interior major surface of the front cover when the shutter assembly is disposed in the return position.

19. The device of claim 16, wherein the shutter element is configured to rotate about a first rail portion of the railed guidance structure when moving from the return position into the blocking position in response to being engaged by the object.

20. The device of claim 19, wherein the shutter element is configured to be translated from the first rail portion to a second rail portion of the railed guidance structure when moving from the return position to the open position when the shutter element is engaged by the plurality of plug blades.

21. The device of claim 20, wherein the railed guidance structure includes a yoke structure coupled to the front cover, the yoke structure including a first railed bearing portion substantially disposed in parallel with a second railed bearing portion.

22. The device of claim 21, wherein the shutter element includes a first indented opening and a second indented opening coupled to the yoke structure, the first indented opening including a first substantially radial bearing interface and the second indented opening including a second substantially radial bearing interface configured to ride the first railed bearing portion and the second railed bearing portion, respectively, from substantially the return position to the open position in response to being engaged by the plurality of plug blades, the shutter being coupled to the railed guidance structure so that the shutter rotationally self-aligns to the plurality of plug blades when the shutter element is translated from the return position to the open position wherein the plurality of plug blades are allowed to mate with the hot receptacle contact and the neutral electrical contact, respectively.

23. The device of claim 22, wherein the each of the first railed bearing portion and the second railed bearing portion include a first portion extending from an interior major surface of the front cover in a substantially perpendicular direction to a pivot position, each of the first railed bearing portion and the second railed bearing portion further extending from the pivot position at a predetermined angle relative the first railed bearing portion such that the shutter element translates from the return position to the open position in a direction parallel to the interior major surface of the front cover a distance substantially equal to a width of one of the plurality of receptacle openings.

24. The device of claim 23, wherein the predetermined angle is greater than about thirty five degrees.

25. The device of claim 16, wherein the shutter element includes an aperture configured to allow one of the plurality of plug blades to pass through in the open position.

26. The device of claim 25, wherein the shutter element includes a seat portion configured to accommodate a spring, the spring being disposed between the seat portion and an anti-probing portion of the front cover.

27. The device of claim 26, wherein the spring is selected from a group of springs that include a torsion spring or a compression spring.

28. The device of claim 16, wherein the return position is centered about an axis parallel to a major surface of the front cover and varies within a predetermined angular range.

29. The device of claim 28, wherein the predetermined angular range ($\Delta R$) is about $-8° \leq \Delta R \leq +8°$.

30. An electrical wiring device comprising:

a housing including a front cover coupled to at least one body member, the front cover including a plurality of receptacle openings in a major front surface thereof, the plurality of receptacle openings being configured to receive a hot plug blade and a neutral plug blade of a corded electrical plug, the at least one body member including at least one set of receptacle contacts including a hot receptacle contact and a neutral receptacle contact configured to mate with the hot plug blade and the neutral plug blade, respectively, when the corded electrical plug is inserted into the plurality of receptacle openings;

a set of electrical terminations accessible via at least one aperture in the housing, the at least one set of receptacle contacts being configured to receive electrical power from the at least a portion of the set of electrical terminations;

a yoke structure coupled to the front cover, the yoke structure including a first railed bearing portion substantially disposed in parallel with a second railed bearing portion, the yoke structure defining a first portion and a translational portion; and a shutter assembly including a shutter element having a first indented opening and a second indented opening coupled to the first railed bearing portion and the second railed bearing portion respectively, the first indented opening including a first substantially radial bearing interface and the second indented opening including a second substantially radial bearing interface configured to ride the first railed bearing portion and the second railed bearing portion, respectively, from a return position to an open position in response to being engaged by the plurality of plug blades, the open position permitting electrical engagement of the plurality of plug blades with the plurality of receptacle contacts, the yoke structure being configured to rotate the shutter element from the return position to a blocking position when disposed on the first portion in response to being engaged by an object via at least one of the plurality of receptacle openings to prevent the object from obtaining access to the at least one set of receptacle contacts.

31. The device of claim 30, wherein the shutter element includes a first major surface disposed on one side thereof and configured to be engaged by the plurality of plug blades, the shutter element further including a second major surface disposed on a second side thereof, the first major surface being substantially parallel to the second major surface.

32. The device of claim 30, wherein the shutter element includes a first major surface configured to be engaged by the plurality of plug blades, the shutter element further including a first lateral rib portion disposed at a first edge of the first major surface and a second lateral rib portion disposed at a second edge of the first major surface parallel to the first edge, the first lateral rib portion and the second lateral rib portion being configured to prevent the first major surface from abutting an interior major surface of the front cover when the shutter assembly is disposed in the return position.

33. The device of claim 30, wherein the each of the first railed bearing portion and the second railed bearing portion include a first portion extending from an interior major surface of the front cover in a substantially perpendicular direction to a pivot position, each of the first railed bearing portion and the second railed bearing portion further extending from the pivot position along the translational portion at a predetermined angle relative the first portion, wherein the shutter element is translated from the return position to the open position in a direction parallel to the interior major surface of the front cover a distance substantially equal to a width of one of the plurality of receptacle openings.

34. The device of claim 33, wherein the predetermined angle is greater than about thirty five degrees.

35. The device of claim 30, wherein the shutter element includes an aperture configured to allow one of the plurality of plug blades to pass through in the open position.

36. The device of claim 30, wherein the shutter element includes a seat portion configured to accommodate a spring, the spring being disposed between the seat portion and an anti-probing portion of the front cover.

37. The device of claim 36, wherein the spring is selected from a group of springs that include a torsion spring or a compression spring.

38. The device of claim 30, wherein the housing includes a wiring device housing, a duplex receptacle housing, a decorator housing, an extension cord housing, a multiple outlet strip housing, a combination receptacle and switch housing.

39. The device of claim 30, further including a protection circuit, a ground fault circuit interrupter, an arc fault circuit interrupter, or a surge protective device.

40. The device of claim 30, wherein the shutter element is configured to rotationally align with end portions of the plurality of plug blades in response to an asymmetry in respective lengths of the plurality of plug blades.

* * * * *